US011197507B2

(12) United States Patent
Ulmer et al.

(10) Patent No.: US 11,197,507 B2
(45) Date of Patent: Dec. 14, 2021

(54) PERSONAL PROTECTION SYSTEM INCLUDING A HOOD WITH A TRANSPARENT FACE SHIELD AND CONTROL BUTTONS ON THE FACE SHIELD

(71) Applicant: Stryker Corporation, Kalamazoo, MI (US)

(72) Inventors: Bryan Ulmer, Grand Rapids, MI (US); Brian James Vanderwoude, Portage, MI (US); Beau Kidman, Kalamazoo, MI (US); David Goldenberg, Mattawan, MI (US)

(73) Assignee: Stryker Corporation, Kalamazoo, MI (US)

( * ) Notice: Subject to any disclaimer, the term of this patent is extended or adjusted under 35 U.S.C. 154(b) by 271 days.

(21) Appl. No.: 16/085,272

(22) PCT Filed: Apr. 17, 2017

(86) PCT No.: PCT/US2017/027857
§ 371 (c)(1),
(2) Date: Sep. 14, 2018

(87) PCT Pub. No.: WO2017/184479
PCT Pub. Date: Oct. 26, 2017

(65) Prior Publication Data

US 2020/0375272 A1 Dec. 3, 2020

Related U.S. Application Data

(60) Provisional application No. 62/324,118, filed on Apr. 18, 2016.

(51) Int. Cl.
*A41D 1/00* (2018.01)
*A41D 13/12* (2006.01)

(52) U.S. Cl.
CPC ..... *A41D 1/005* (2013.01); *A41D 13/1218* (2013.01)

(58) Field of Classification Search
CPC ..... A41D 1/005; A41D 1/002; A41D 13/11; A41D 13/12; A41D 13/1153;
(Continued)

(56) References Cited

U.S. PATENT DOCUMENTS 4,138,746 A 2/1979 Bergmann
6,418,019 B1 7/2002 Snyder et al.
(Continued)

FOREIGN PATENT DOCUMENTS

CN 2040717 U 7/1989
CN 1795362 A 6/2006
(Continued)

OTHER PUBLICATIONS

International Search Report for Application No. PCT/US2019/015128 dated Jun. 21, 2019, 5 pages.
(Continued)

*Primary Examiner* — Alissa J Tompkins
*Assistant Examiner* — F Griffin Hall
(74) *Attorney, Agent, or Firm* — Howard & Howard Attorneys PLLC

(57) ABSTRACT

A personal protection system (30,178,290) including a helmet (32,180) to which a garment (102,236) is mounted. The helmet (32,180) includes an electrically powered assembly such as a fan (92,266,268,272). At least one button (120, 134,262,264) for regulating operation of the electrically powered assembly (92,266,268,272) is mounted to the face shield (110,240) of the garment (102,236). The helmet (32,180) includes a detector (85) that is connected to and monitors the state of the button (120,134,262,264). When the button (120,134,262,264) is depressed, the detector (85)
(Continued)

sends a signal to a controller (88) that regulates the actuation of the electrically powered assembly. The controller (88) then sets the operating state of the assembly (92,266,268,272) so that the assembly (92,266,268,272) operates in the state desired by the individual wearing the personal protection system (30,178,290) based on the depression of the control button (120,134,262,264).

21 Claims, 20 Drawing Sheets

(58) Field of Classification Search
CPC ..... A41D 13/0025; A41D 13/1218; A62B 17/04; A62B 18/04; A62B 18/045; A42B 3/28; A42B 3/286; A42B 3/044; A42B 3/225
USPC ..... 2/424
See application file for complete search history.

(56) References Cited

U.S. PATENT DOCUMENTS

| | | | | |
|---|---|---|---|---|
| 6,481,019 | B2 * | 11/2002 | Diaz | A41D 13/11 128/201.19 |
| 6,954,968 | B1 | 10/2005 | Sitbon | |
| 7,093,302 | B1 | 8/2006 | Burns | |
| 7,181,777 | B2 * | 2/2007 | Choi | A42B 3/222 2/424 |
| 7,735,156 | B2 | 6/2010 | VanDerWoude et al. | |
| 7,926,118 | B2 | 4/2011 | Becker et al. | |
| 8,407,818 | B2 | 4/2013 | VanDerWoude et al. | |
| 8,621,375 | B2 | 12/2013 | Berger et al. | |
| 8,745,763 | B2 | 6/2014 | Cho | |
| 2005/0010992 | A1 | 1/2005 | Klotz et al. | |
| 2007/0157371 | A1 | 7/2007 | Nagely | |
| 2009/0151054 | A1 | 6/2009 | VanDerWoude et al. | |
| 2013/0191976 | A1 | 8/2013 | Pizzi | |
| 2015/0090254 | A1 | 4/2015 | Pavalarajan et al. | |
| 2015/0375019 | A1 | 12/2015 | VanDerWoude et al. | |
| 2016/0044276 | A1 | 2/2016 | Shearman et al. | |
| 2016/0052491 | A1 | 2/2016 | Friscioni | |
| 2018/0263326 | A1 | 9/2018 | Ulmer et al. | |

FOREIGN PATENT DOCUMENTS

| | | | |
|---|---|---|---|
| CN | 201070034 | Y | 6/2008 |
| CN | 104720155 | A | 6/2015 |
| CN | 204580025 | U | 8/2015 |
| CN | 105394860 | A | 3/2016 |
| DE | 202007002332 | U1 | 5/2007 |
| WO | 0111646 | A2 | 2/2001 |
| WO | 2001052675 | A2 | 7/2001 |
| WO | 2007011646 | A2 | 1/2007 |
| WO | 2009079292 | A1 | 6/2009 |
| WO | 2017053232 | A1 | 3/2017 |
| WO | 2017112485 | A1 | 6/2017 |

OTHER PUBLICATIONS

English language abstract for CN 2040717 U extracted from espacenet.com database on Feb. 24, 2021, 1 page.
English language abstract and machine-assisted English translation for CN 2040717 U extracted from espacenet.com database on Feb. 24, 2021, 6 pages.
English language abstract and machine-assisted English translation for CN 104720155 A extracted from espacenet.com database on Feb. 24, 2021, 6 pages.
English language abstract and machine-assisted English translation for CN 204580025 U extracted from espacenet.com database on Feb. 24, 2021, 6 pages.
English language abstract and machine-assisted English translation for CN 105394860 a extracted from espacenet.com database on Feb. 24, 2021, 9 pages.
International Search Report for Application No. PCT/US2017/027857 dated Oct. 18, 2017, 2 pages.
English language abstract and machine-assisted English translation for DE 20 2007 002 332 U1 extracted from espacenet.com database on Apr. 19, 2021, 19 pages.
English language abstract and machine-assisted English translation for CN 1795362 A extracted from espacenet.com database on Jul. 12, 2021, 53 pages.
Qu, Dong-Cai, "English language abstract of Helmut-Mounted Display and Key Technology", Dec. 31, 2002, 1 page.

* cited by examiner

292

| | |
|---|---|
| GARMENT IDENTIFICATION | 302 |
| MINIMUM FAN SPEED | 304 |
| FLAG SETTINGS | 306 |
| USER HISTORY | 308 |

FIG. 15

PERSONAL PROTECTION SYSTEM INCLUDING A HOOD WITH A TRANSPARENT FACE SHIELD AND CONTROL BUTTONS ON THE FACE SHIELD

This application is a U.S. National Stage of International Patent Application No. PCT/US2017/027857, filed on Apr. 17, 2017, which claims the benefit of and priority to U.S. Provisional Patent Application Ser. No. 62/324,118, filed on Apr. 18, 2016, the entire contents of each is hereby incorporated by reference in its entirety.

FIELD OF THE INVENTION

This invention relates generally to a personal protection system. More particularly, the personal protection system of this invention includes a helmet and a removable hood. The hood has buttons that are actuated to control the operating of the system.

BACKGROUND OF THE INVENTION

During some medical and surgical procedures, a healthcare provider will wear an assembly known as a personal protection system. This type of assembly includes a helmet. A protective garment is placed over the helmet to, at a minimum, cover the head of the wearer. A garment that only extends a short distance below the head is sometimes referred to as a hood. A garment that extends to the waist or even below the waist is referred to as a gown or a toga. Regardless of the length, the garment includes a transparent face shield. The fabric forming the garment provides a barrier between the healthcare provider and the ambient environment. The face shield is a transparent part of this barrier that allows the individual a view of the location at which the procedure is being performed.

The barrier benefits both the patient and the healthcare provider. The barrier substantially eliminates the likelihood that the healthcare provider may come into contact with fluid or solid bits of matter from the patient that may be generated during the course of the procedure. Also, a healthcare provider, like any individual, invariably emits microscopic and near microscopic sized dead skin cells, perspiration droplets and saliva. The barrier provided by the personal protection system substantially eliminates the possibility this material will land on the normally concealed tissue of the patient that is exposed in order to perform the procedure. The limiting of the extent to which the patient's internal tissue is exposed to this material results in a like reduction in the likelihood that the material will induce an infection in tissue.

If an individual simply wears a garment over the head, an inevitable result of that individual's breathing would be the buildup of carbon dioxide and water vapor under the garment. No one, especially a healthcare worker performing a procedure, wants to be subjected to the harmful effects of excessive exposure to carbon dioxide. If water vapor is allowed to build up inside the garment, the vapor could condense against the inside surface of the face shield. The formation of these water droplets can reduce the visibility through the face shield.

To avoid the undesirable results of carbon dioxide and water vapor from building up under the garment of a personal protection system, a fan is mounted to the helmet of the personal protection system. The fan draws fresh air into the space under the garment, the space around the head of the person wearing the system. This air forces the carbon dioxide and water vapor laden air away from around the head of the individual wearing the system. Examples of such systems are described in U.S. Pat. No. 6,481,019/PCT Pub. No. WO 2001/052675 and U.S. Pat. No. 7,735,156/PCT Pub. No. WO 2007/011646 each of which is incorporated herein by reference. These personal protection systems both provide a barrier around an individual wearing the system and prevent the undesirable build up of carbon dioxide and water vapor under the garment.

A personal protection system includes at least one, if not more, control buttons or switches. At a minimum, most personal protection systems are provided with control buttons that are depressed by the individual wearing the system so the individual can control the speed of the fan. This is desirable because the individual will typically want to set the fan so the fan operates at speed that is high enough to ensure the environment under the hood is comfortable. At the same time, the individual will not want to set the fan to operate at speed so high that the noise generated by the fan appreciably interferes with the ability of the person to concentrate on the procedure that is to be performed. Further, auxiliary equipment is sometimes mounted to the helmet of a personal protection system. This auxiliary equipment may include an outwardly directed light. During some procedures a practitioner finds this light useful for illuminating the tissue in the area in which the procedure is being performed. One reason this light is useful is that it can help the practitioner, by studying the color of the tissue, determine the type and/or health of the tissue. Another type of auxiliary unit that is sometimes mounted to a helmet of a personal protection system is a unit that includes a microphone. Some of these units are radio transceivers. These units allow the person wearing the personal protection system to communicate with other individuals both in and out of the room in which the procedure is being performed. This can be useful because, when wearing a personal protection system, owing to the presence of the hood over the individual, it may sometimes be necessary to speak in a loud voice in order to be heard. In an alternative unit that includes a microphone is a unit that includes an amplifier and a loudspeaker. This type of unit broadcasts the speech of the person wearing the unit through the hood to the adjacent surrounds. This type of unit offers another means to ensure that the individual wearing a personal protection system can, when speaking with a normal voice, be heard through the hood that extends around this person's head.

Each of these pieces of equipment typically includes one or more buttons so the individual wearing the personal protection system can control the operating state of the equipment. As discussed above, the fan includes at least one control button for controlling the speed of the fan. If the helmet includes a light, a button is provided to control the on/off state of the light. If the helmet includes an assembly that broadcasts speech, either as radio waves or simply amplified speech, a button is typically provided to control the on/off state of this assembly.

Also, as disclosed in the incorporated by reference US Prov. Pat. App. No. 62/221,266/PCT App. No. PCT/US2016/052491 the contents of which are published in US Pat. Pub. No. 2018/0263326/PCT Pub. No. WO 2017/053232, the helmets of some personal protection units are provided with cooling modules. These cooling modules typically consist of one or more Peltier type cooling modules. This type of helmet is designed so that when worn the heat sinking portion of the cooling module is adjacent if not in contact with the skin of the individual. The module, when actuated, draws the thermal energy of the individual away from the individual. This facilitates the maintenance of the body temperature of the individual within a range the individual finds comfortable. When a personal protection system is provided with these one or more cooling modules, the system typically includes one or more buttons that allow the individual to custom set the rate at which the modules draw heat away from the individual.

One present practice is to mount the one or more buttons integral to a personal protection system to the system helmet. Once the individual puts on the personal protection system, the buttons are covered by the hood portion of the garment. The incorporated by reference U.S. Pat. No. 6,418,019/PCT Pub. No. 2001/011646 discloses a personal protection system with control buttons that are mounted to the outer surface of the helmet. More specifically, these buttons are mounted to the helmet above and slightly behind an ear of the individual wearing the helmet. When an individual wants to depress one of these buttons, he/she must move a hand outside of the sterile field and to the location above the ear. (The sterile field is generally the space in front of the individual between the waist and the neck.) If the individual is in the vicinity of suspended equipment, such as a light, the individual must take care to ensure that as the hand moves to the button, the hand does not inadvertently contact the light. This type of contact may result in the hand even though gloved, being considered unsterile. This would then require the interruption of the procedure so the individual can reglove.

Having to so position the hand in order to depress the button is further complicated by the fact that, since these buttons are located adjacent the ear, they are out of the line of sight of the individual wearing the helmet. This means the individual cannot rely on visual cues to precisely position the hand in order to depress a button. In practice, when this type of system is employed some surgeons have the circulating nurse, an individual located outside of the sterile field depress the control buttons. This relieves the surgeon of having to focus on proper hand placement in order to adjust the operating state of the personal protection system.

The absence of these visual cues can also make it difficult for the surgeon to be confident that he/she is depressing the control button that he/she wants to depress. This potential for confusion serves to limit the number of control buttons that tend to be mounted to a personal protection system helmet. Limiting the number of buttons can limit the number of control options that are provided to the individual wearing the system.

The previously incorporated by reference U.S. Pat. No. 7,735,156/PCT Pub. No. WO 2007/011646, discloses a personal protection system in which the buttons are mounted to a bottom portion of the chin bar. The chin bar is a U-shaped structure that extends downwardly from the shell. A helmet is typically designed so that when worn, the chin bar extends down from locations spaced outwardly and forward of the sides of the face. The chin bar includes a beam, that is at least semi-rigid, that is located forward of and slightly below the chin of the individual. The primary purpose of the chin bar is to provide structural support for the face shield. More specifically, the chin bar is the structural component of the helmet that prevents the face shield from collapsing inwardly against the face of the individual wearing the personal protection system. Many personal protection systems are designed so that fastening elements that temporarily hold the garment to the helmet are mounted to the face shield. Many of these personal protection systems are designed so the fastening elements integral with the chin bar engage complementary fastening elements that are mounted to the face shield of the garment.

When the control buttons are mounted to the chin bar, the buttons are often located in the web portion of the bar that is located below the chin of the individual. An individual wanting to depress a button will raise his/her hand to the bar and, by depressing the portion of the garment covering the button, depress the button. A benefit of so positioning the control buttons is that the individual wanting to depress the buttons does not have to move his/her hand to a location that is appreciably out of the sterile field. Further, since the hand is substantially in front of the face of the individual during this process, the hand is within the field of the view of the individual. This makes it possible to, by relying at least partially on sight, promptly and accurately position the hand so the button targeted for actuation can be so depressed.

Given, the relative ease of access, personal protection systems with chin bar mounted control buttons are a popular alternative to predecessor systems. Nevertheless, in some surgical procedures, a significant amount of fluid may end up being discharged from the patient and towards the individuals wearing the procedure. These fluids include blood and irrigating fluid contaminated with other fluids. Small tissue particles may also be discharged from the patient. When this material is discharged, the system performs as intended, the fluid lands on the garment instead of the skin or clothing of the person wearing the system. An individual wanting to press a chin bar-mounted button sometimes has to press against a portion of the fluid-coated garment. To ensure that this pressing of finger or thumb against the garment does not result in fluids or other contaminates being forced through the garment it is a practice to make the garment out of material of reduced permeability than some previously available garments. This material, being less permeable, is less breathable than the previously available garments. This reduction in breathability can, over time contribute to the discomfort associated with having to wear a personal protection system. Further this material can be more expensive to provide than the material from which the prior art garments are formed. Having to form a garment out of this more expensive material can add to the cost of providing the garment.

Furthermore, some personal protection systems are configured so that, as soon as the individual connects a battery pack to a helmet, the fan is actuated. This event occurs even though a covering garment has not been placed over the helmet and head. This results in the needless generation of noise by the fan. This also results in the depletion of the charge stored in the system battery even though the operation of the fan is not serving any useful purpose.

SUMMARY OF THE INVENTION

This invention is related to a new and useful personal protection system. The protection system of this invention is the type of protection system that can be employed to provide a sterile barrier between an individual and the surrounding environment in a medical or surgical setting. The personal protection system of this invention includes one or more buttons for controlling the operating state of the system. The buttons of this system are positioned so as to be easily accessible by the person wearing the system and located in a place in which it is clear that depressing the button will not result in material on the button from being pushed through the barrier formed by the system.

The personal protection system of this invention includes a garment and a helmet. The garment covers at least the helmet and at least the head of the individual wearing the helmet. Internal to the helmet are electrically active components. Typically, at a minimum, these components regulate the environment inside the garment. The helmet includes a transparent face shield. The face shield is formed from a transparent plastic.

The invention further includes at least one control button mounted to the face shield. One or more conductors, also disposed on the face shield, extend from each button. The conductors extend to contacts mounted to the face shield. The helmet includes contacts that are complementary to the face shield contacts. The helmet contacts are electrically connected to a controller mounted to the helmet.

An individual using this personal protection system readies the system for use by first putting on the helmet. The garment is placed over the helmet. As a result of the fitting of the garment over the helmet, the face shield contacts engage the helmet contacts. Each button is thus connected to the controller.

When the individual wants to set the operating state of the electrically active components, the individual depresses the appropriate one of the face shield mounted buttons. The depression of the button is sensed by the controller. The controller, in turn, makes the appropriate adjustment to the operating state of the personal protection system.

The buttons are mounted to a layer sheet of plastic. The individual, when depressing a button, does not therefore feel as if this action could result in any material on an adjacent the button being pressed through the portion of the barrier formed by the face shield.

In some versions of the invention, the contacts are integral with components that hold the face shield to the helmet and/or align the face shield with the helmet. In some versions of the invention, the complementary face shield and helmet contacts are electrically conductive components that also engage to physically hold the face shield to the helmet. In other versions of the invention, the face shield contacts extend to face shield features that perform a fastening and/or aligning function. This type of feature can be an opening or notch on the face shield. The helmet is formed with a complementary tab that seats in the face shield opening or notch. The helmet contact is located adjacent this tab. Consequently, the seating of the helmet tab in the face shield opening or notch, results in the helmet contact engaging the complementary contact integral with the face shield.

In some versions of the invention, each button consists of the geometric features of two conductors formed on the face shield. These geometric features are closely located to each other. Integral with the helmet is a detector. The detector is capable of sensing the change in the state of the signal across the terminal structures. This change may be due to a change in state of a variable such as the capacitance or resistance across the geometric features. The individual wearing the personal protection system actuates a button by placing a finger or thumb in close proximity to these geometric features. This action changes either the capacitance or resistance that is sensed by the detector. In response to the detector determining that this state change has occurred, the detector sends a signal to the controller that the button with which the terminal structures are associated was depressed.

The invention is also related to a personal protection system designed so that, only when a garment is fitted over the system helmet is the fan actuated.

BRIEF DESCRIPTION OF THE DRAWINGS

The invention is pointed out with particularity in the claims. The above and further features and benefits of this invention are understood from the following Detailed Description taken in conjunction with the accompanying drawings in which:

FIG. 15 depicts some the data that may be stored in the memory integral with the garment;

DETAILED DESCRIPTION

I. Basic System

A personal protection system 30 of this invention includes a helmet 32 that is worn over the head of the individual wearing the system. System 30 also includes a garment 102. At a minimum, the garment 102 extends over the helmet 32 and the head of the person wearing the system. Garment 102 forms a protective barrier around the portions of the individual covered by the garment. Internal to the helmet is a fan 94, seen in FIG. 3. The fan 94 draws air into the garment 102 to maintain the environment beneath the garment in a state in which it is comfortable to the individual wearing the system 30.

Figure 2:
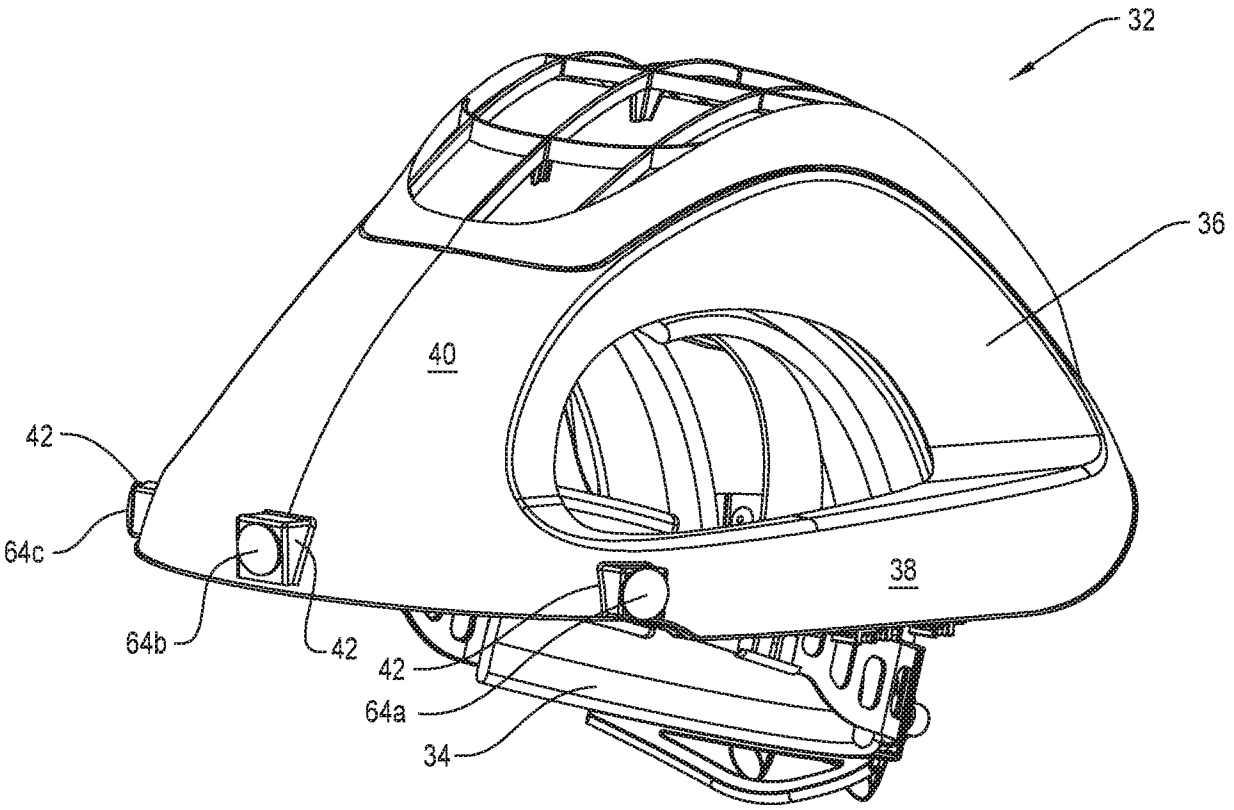
FIG. 2 is a perspective view of the helmet of the personal protection system of this invention.
Figure 3:
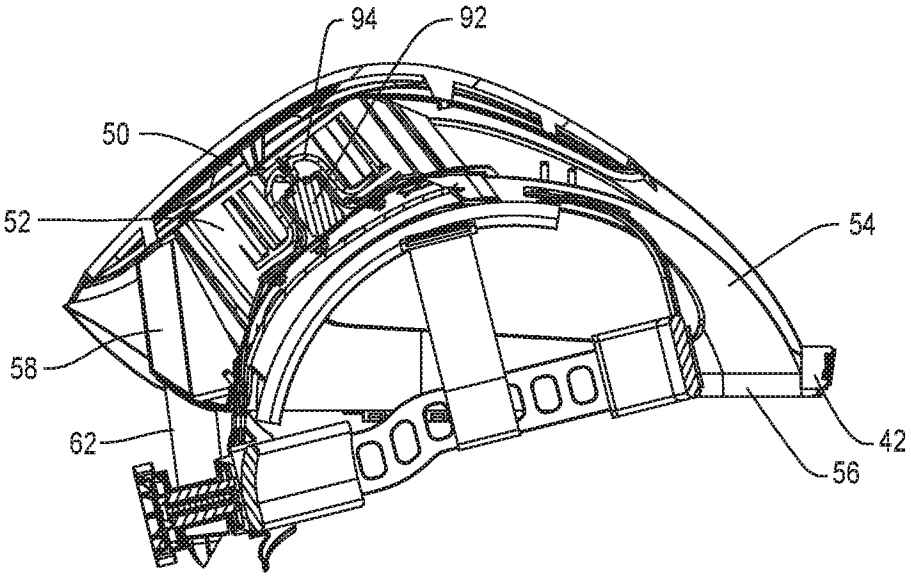
FIG. 3 is a cross sectional view of the helmet.

The helmet 32 as seen in FIGS. 2 and 3, includes a headband 34. As implied by the name, headband 34 is designed to fit around the head of the individual wearing the system 30. A shell 36 is mounted to and disposed over the headband 34. The shell 36 is shaped to fit over the head of the individual wearing the personal protection system 30. Shell 36 is shaped to form a rim 38. The rim 38 is the bottom part of the shell 36. The rim 38 is generally located at or above the level of the headband 34. The rim 38 extends circumferentially around the head of the individual wearing the system 30. The depicted shell 36 includes an arcuately shaped web 40. The web 40 is the portion of the shell that extends over the top of the head of the individual wearing the helmet 32. Shell 36 is formed so the web 40 extends between the opposed front and back portions of the rim 38. The shell 36 is further formed so as to have plural pylons 42 that project forward from the rim 38. The depicted version of the invention includes three pylons 42. One pylon 42 projects forward from the center of the forward facing surface of the rim 38. The remaining two pylons 42 are located on the opposed sides of the center located pylon 42.

Many portions of the shell 36 are formed to define voids. One void is the center void 52 formed in the web 40. This center void 52 is located more towards the rear of the shell 36 than the front. The shell 36 is further formed so the web 40 has, in the top, an opening 50 into the void 52. A second void in shell 36 is the front duct 54. The front duct 54 extends from the center void 52 to a discharge opening 56 formed in the bottom edge of the shell rim 38. Discharge opening 56 is located in the portion of the shell 36 immediately below pylon 42.

An additional void in shell 36 is the rear duct 58. The rear duct 58 extends rearwardly from the center void 52 the back or rear of the shell 36. One or more nozzles 62 is mounted to the rear of the shell. Nozzles 62 extend downwardly from the shell rim 38 and below the section of the headband 34 located below the shell 36. Rear duct 58 extends to the nozzles 62.

Figure 3A:
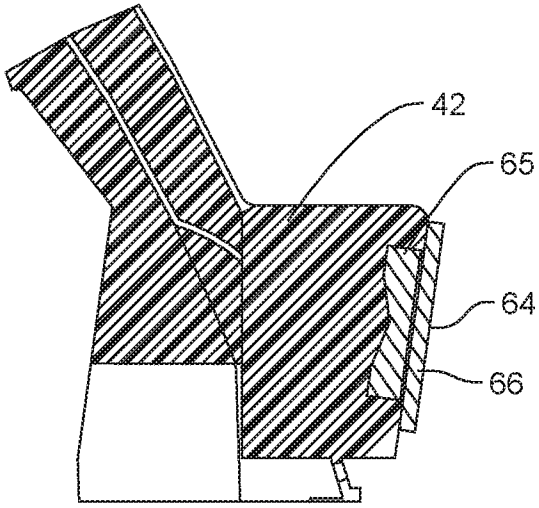
FIG. 3A is an enlarged cross section view of the front of the helmet.
Figure 5A:
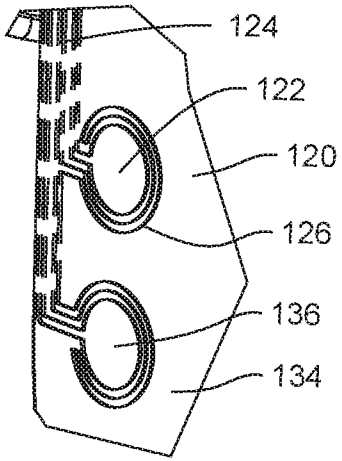
FIG. 5A is an enlarged view of the portion of the inside of the face shield where the conductive material disposed on the face shield forms the plural buttons on the face shield.
Figure 5:
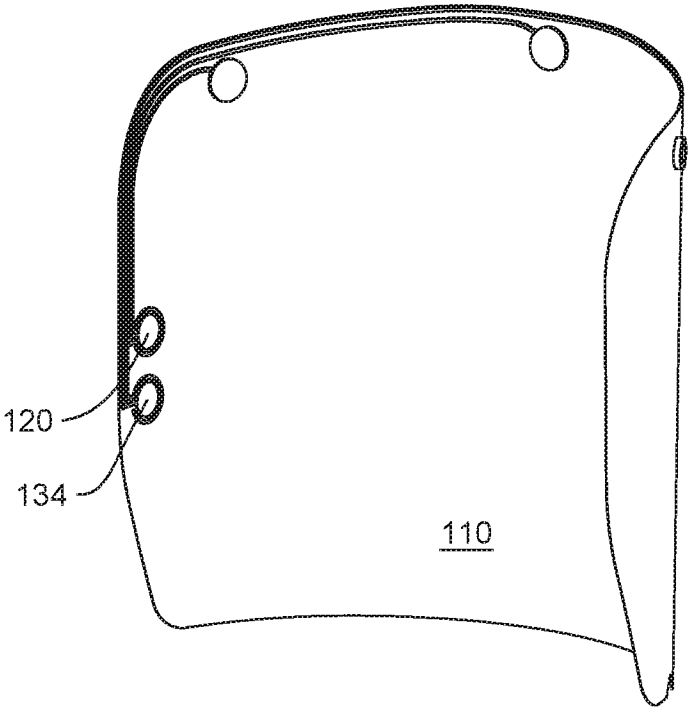
FIG. 5 is a perspective view of the inner surface of the face shield of the garment integral with the system of this invention.
Figure 6:
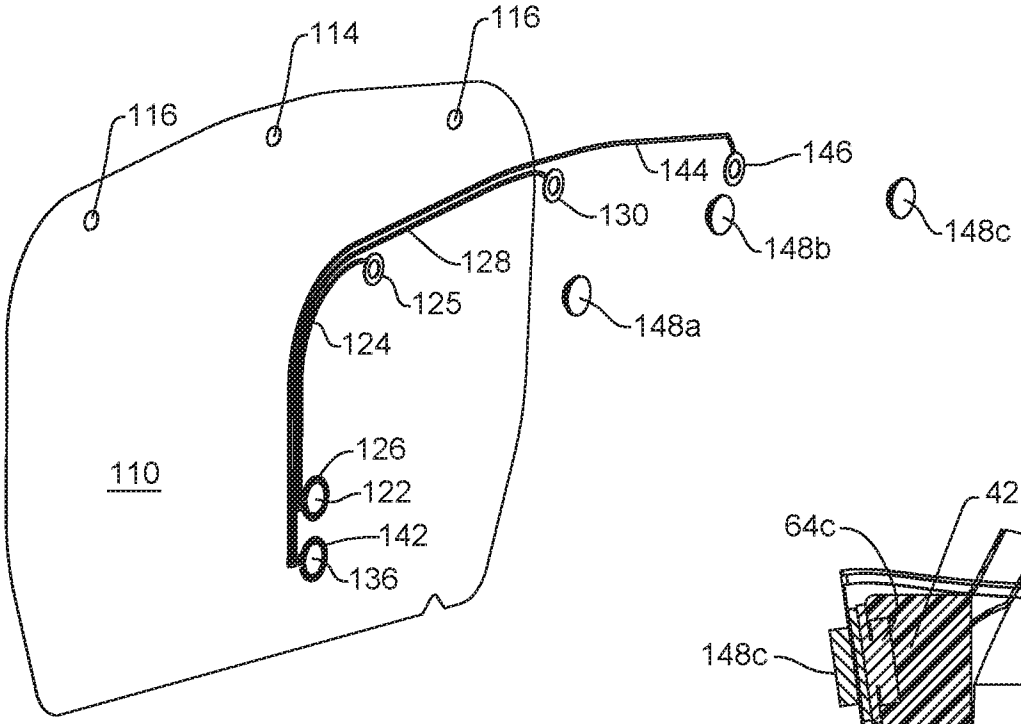
FIG. 6 is an exploded view of the face shield and the components attached to the face shield.

Plural magnets 64 are mounted to the shell 35 (two magnets identified). One magnet 64 is mounted to each pylon 42. Each magnet 62 is formed to have a base 65 and a head 66. The head 66 is larger in diameter than the base 65. Each magnet 64, as seen in FIG. 3A, is mounted to the associated pylon so the base of the magnet is embedded in the pylon. The head 66 is located forward of the base so as to extend forward of the outwardly directed face of the pylon 42. Magnets 64 are formed from material that is both magnetic and electrically conductive. In one version of the invention, the magnets 64 are formed from Nickel-Copper plated Neodymium Iron Boron.

The fan 94 is disposed in the center void 52 of the shell. A motor 92, also disposed in void 52, spins the fan 94. Fan 94 is designed to, when actuated, draw air in through opening 50 and force the air outwardly through the ducts 54 and 58. The air forced through the front duct 54 is discharged through opening 56. The air forced through the rear duct 58 is discharged through the one or more nozzles 62.

Figure 4:
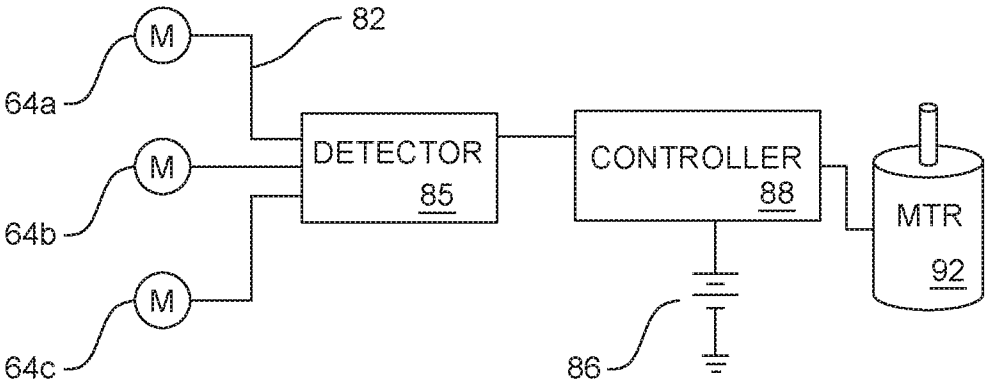
FIG. 4 is a block diagram of the electrically active components of the helmet.

FIG. 4 depicts, in block diagram, the electrical components of the helmet 32. These components include the three magnets 64. An electrical conductor 82, one conductor identified, extends from each magnet 64 to a detector 85. Detector 85 monitors the characteristics of the signals applied to the detector from the conductors. Specifically, the detector 85 determines when, as a result of one of the below discussed buttons 120 and 134 integral with the garment 102 is depressed, the characteristics of the signals across the conductors 82 change. In one version of the invention, detector 85 monitors changes in the signal as a result of changes in capacitance. Specifically, the detector 85 monitors changes in capacitance as indicated by changes in the characteristics of the signal between magnets 64*a* and 64*b* and also changes in capacitance as indicated by changes in the characteristics of the signal between magnets 64*b* and 64*c*. In one version of the invention the PCF8883 Touch/Proximity Sensor available from NXP Semiconductor of Eindhoven, Netherlands functions as the detector 85.

The signals output by the detector 85 are applied to a controller 88. Controller 88 is configured to selectively apply the energization signals from a battery 86 to the motor 92. More particularly, in response to the signals output by the detector 85, the controller 88 sets the characteristics of the energization signals sourced from the battery 86 to the motor 92. This causes the fan 94 to operate in a state in which air is flowed through the garment at a rate desired by the individual wearing the system 30.

Battery 86 it is understood is often worn around the waist of the individual wearing the personal protection system 30. Not shown and not part of the present invention is the cable that connects the battery 86 to the helmet 32. Also not shown and not part of the present invention is the circuit board internal to the shell 36 to which the detector 85 and controller 88 are mounted.

Figure 1:
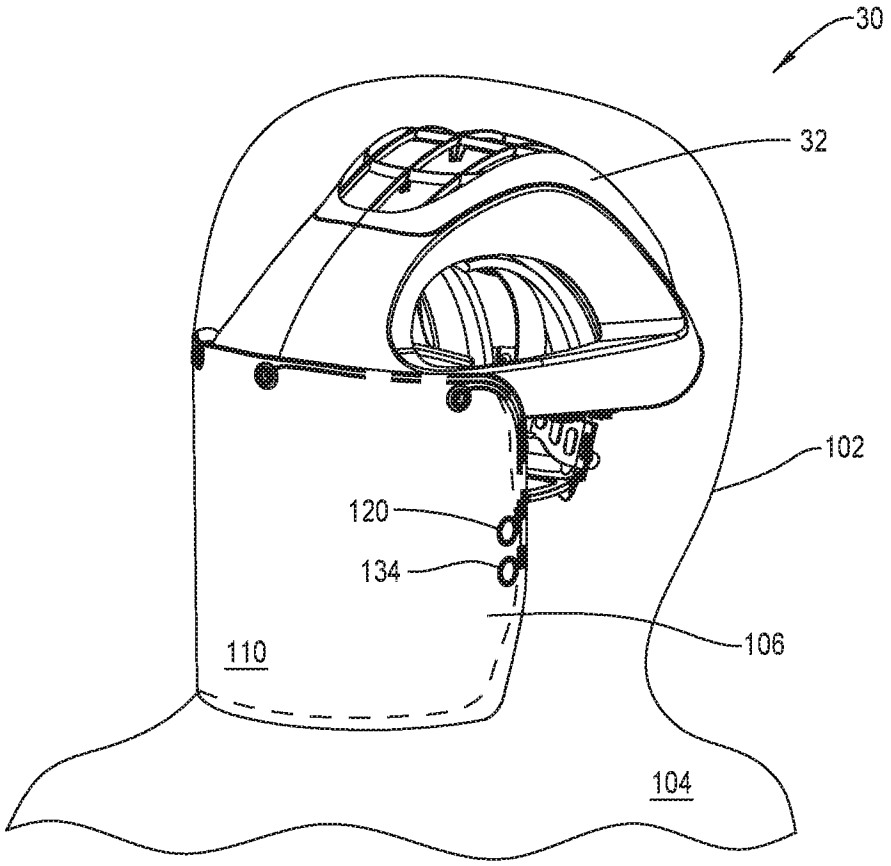
FIG. 1 is perspective view of a personal protection system of this invention.

Returning to FIG. 1, it is understood that the garment 102 includes a shell 104. In FIG. 1, the outline of the shell 104 is shown so the other components of system 30 can be seen. Shell 104 is formed from a flexible fabric capable of functioning as a viral barrier. In some versions of the invention, the shell 104, and by extension the whole of the garment 102, is shaped only to cover, the helmet 32, the head and portions of the individually wearing the system above the shoulder. In these versions of the invention, the garment 102 is referred to as a hood. In other versions of the invention, the shell 104 is formed with sleeves and extends to at least the waist. In these versions of the invention the garment 102 is formed is referred to as a toga. While not seen in the drawings, the garment is typically formed so that where the shell would normally be present over the web 40 of the helmet there is a filter. The filter is formed from material that is often a non-woven polypropylene.

The portion of the shell shaped to fit over the head of the individual is formed with an opening 106. A flexible, transparent face shield 110 is secured over the opening 106. In some versions of the invention, the face shield 110 is formed from polycarbonate. One such polycarbonate is sold under the trademark LEXAN by Sabic. The face shield is sheet like in structure and typically has a thickness of 1 mm or less. The face shield 110 is secured to the opening so the outer perimeter of the face shield overlaps the inner surface of the shell 104 that surrounds opening 106. In FIG. 1, this is represented by the dashed line above the bottom and right perimeter portions of the face shield. High tack rubber adhesive is used to secure the face shield 110 to the shell.

Face shield 110, as seen in Figured 5, 5A and 6, is formed so that below the top of the face shield there is a center opening 114 and two side openings 116. The garment 102 is formed so that when the face opening 114 is in registration with the center magnet 64*b* and the face shield then flexed around the rim 38 of the helmet 32, each of the side openings 116 go into registration with one of the side-located magnets 64*a* and 64*c*.

Two manually actuatable buttons 120 and 134 are formed on the face shield 110. The buttons 120 and 134 are located on a side of the face shield. Buttons 120 and 134 comprise electrically conductive traces formed on the inner surface of the face shield 110. The conductive traces may be formed from graphene or silver based inks and have a thickness of 1 mm or less and, more preferably 0.5 mm or less. The buttons 120 and 134 are located inwardly of where the face shield 110 is mounted to the shell 104. Button 120 includes an electrical conductive circular shaped disk 122 that is formed on the inner surface of the face shield 110. Button 120 also includes an electrically conductive ring 126 that partially surrounds the disk. Ring 126 subtends an arc that extends at least 180° around the disk. Collectively, the disk 122 and ring 126 are formed so that when a finger or thumb contacts the section of the face shield on which button 120 is formed, there will be a change of a characteristic of the signal across these components that can be sensed by detector 85.

Again, in the described version of the invention, detector 85 measures changes in capacitance. Thus, in this version of the invention, the detector 85 applies a signal across disk 122 and ring 126. The detector 85 monitors changes in the characteristics of the signal. In this version of the invention, the presence of the finger or thumb changes the dielectric characteristics between disk 122 and ring 126. In these versions of the invention, disk 122 may have a diameter of between 10 and 20 mm. Ring 126 may be spaced between 1 and 5 mm from the outer perimeter of the disk 122. The conductive material forming the ring may have a side-to-side width of between 1 and 5 mm.

Button 134 includes a disk 136 similar to disk 122. A ring 142 similar to ring 126 at least partially surrounds disk 136. Button 134 thus functions like button 120. When a thumb or finger is placed against the section of the face shield 110 on which button 134 is formed, there is a change in the capacitance across disk 136 and ring 142.

Plural conductors 124, 128 and 144 are also formed on the inner surface of the face shield 110. The conductors 124, 128 and 144 as well the below described rings 125, 130 and 146 are sections of the same conductive traces that form the buttons 120 and 134. Conductor 124 extends from disk 122. The conductor extends upwardly along the side of the face shield. At the top of the face shield the conductor 124 extends towards the center of the face shield. Conductor 124 terminates at a conductive ring 125 also formed on the insider of the face shield. Ring 125 is formed around a portion of the face shield that forms one of the openings 116. Both rings 126 and 142 are connected to the second conductor, conductor 128. Conductor 128 extends along the inner surface of the shield along a path of travel essential parallel to that of conductor 124. Conductor 128 extends to a ring 130 formed on the inner surface of the face shield. Ring 130 extends around the portion of the face shield that defines opening 114. Conductor 144, the third conductor, extends from disk 136. Conductor 144 extends along a path parallel to that of conductors 124 and 128. Conductor 144 terminates at a ring 146 similar to ring 130. The ring 146 is disposed around the second opening 116.

Also mounted to the face shield 110 are three magnets 148*a*, 148*b* and 148*c*. Magnets 148*a*, 148*b* and 148*c* may be formed from the same material and have the same or similar shape as magnets 64. The base of each magnet 148*a*, 148*b*, 148*c* is mounted in one of the openings 114 or 116. Magnets 148 are mounted to the face shield 110 so the head of each magnet extends inwardly from the inner face of the face shield. Magnet 148*a* is shown in electrical contact with one of the ring 125. Magnet 148*b* is in electrical contact with ring 130. Magnet 148*c* is in electrical contact with ring 146.

An individual prepares the personal protection system 30 of this invention for use by first placing the helmet 32 over the head. If necessary, the battery 86 is connected to the helmet. Garment 102 is then placed over the helmet 32 and. at a minimum, over the head of the individual. Again, the toga-style versions of the garment 102 extend over the arms and at least to the waist. As part of the process of fitting the garment to the individual, the face shield is flexed around the front of the rim 36 of the shell. Garment 110 is releasably secured to the helmet by pressing each garment magnet 148*a*, 148*b*, 148*c* against, the complementary helmet magnet 64*a*, 64*b*, 64*c*, respectively.

Figure 7:
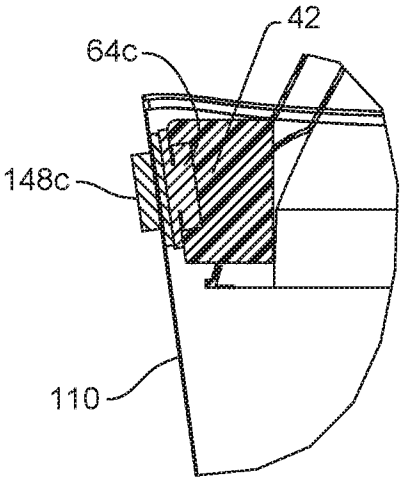
FIG. 7 is a cross section view depicting the face shield releasably secured to the helmet.

As a consequence of the magnets 64*a*, 64*b*, 64*c* and 148*a*, 148*b*, 148*c* being placed in contact with each other and the material from which the magnets are made, an electrical connection is made between each pair of abutting magnets. FIG. 7 depicts the engagement of one pair of magnets, arbitrarily magnets 64*c* and 148*c*, with each other. This means that as a consequence of the releasably attaching the garment 102 to the helmet, electrical connections are made from buttons 120 and 134, over conductors 124, 128 and 144, magnets 148, magnets 64 and conductors 82, to the detector 85.

An individual is therefore able to control the operating of system 30 by depressing the buttons 120 and 134. In this version of the invention, the individual is able to lower the motor/fan speed by contacting button 120 and raise the motor/fan speed by contacting button 134. When the individual wants to increase the speed of the fan 94, the individual, brings a finger toward one of the buttons, arbitrarily button 120. The presence of the finger on the section of the face shield 110 on which disk 122 and ring 126 of the button 120 are formed changes the nature of the dielectric constant between disk 122 and ring 122. This changes the capacitance of button 120. Again, detector 85 continually monitors the changes in characteristics of the signals across the conductive disk and ring that form each buttons 120 and 134. When there is a change in capacitance as a result of the finger being placed against the section of the face shield 110 forming the button 120, there is a change in the characteristic of the signal across the disk 122 and ring 126 forming this button. Detector 85, in response to determining that this signal change has occurred, outputs a signal to the controller 88 indicating that this change has occurred. Controller 88 interprets this signal as an indication the individual wants to increase the speed of the fan 94, actual the speed of the motor 92. The controller 88 therefore resets the characteristics of the energization signals applied to the motor 92 so as to cause the motor and, by extension fan 94, to run at a higher RPM.

In this version of the invention, the individual lowers fan speed by placing a finger in close proximity to the section of the face shield on which button 134 is formed. The resultant change in the capacitance across disk 136 and ring 142 of button 132 is collectively interpreted by the detector 85 as indication that the speed of the motor 92 should be lowered.

When an individual using system 30 of this invention wants to set the state of the system, the individual presses against the section of the face shield forming the appropriate button 120 or 134. The individual does not have to press against the fabric portion of the garment. In other words, to change system state, the individual placing a finger against the non-porous component of the garment, the face shield 110. The individual does not have to feel that, to change the system state that pressing a finger against a button will result in liquids being forced through the porous section of the garment. The elimination of this feeling results in a like elimination of the reluctance the individual may otherwise have had to actuating a button when the portion of the body over which the button is disposed is coated in bodily fluids.

In many versions of this invention the signal detector 85 applies across each button results in a power dissipation across the button of less than 100 mW. The current through the button is less than 50 mAmp. Consequently, given the relatively low power of the signal through the buttons, there is typically not a need to provide an insulating layer over either the buttons 120 and 134 or the conductors 124, 128, 144 that extend to the buttons. One benefit gained by not having to provide this insulating layer is that the cost of providing this layer is avoided. Another benefit of not having to provide this insulating layer is that the layer may add an additional visual discontinuity to the face shield. It is understood that the face shield should, ideally be fully transparent. Minimizing the visual discontinuities integral with the face shield minimize the extent to which these discontinuities are distracting to either the individual wearing the personal protection system or an individual looking at the individual wearing the personal protection system.

II. First Alternative System

Figure 8:
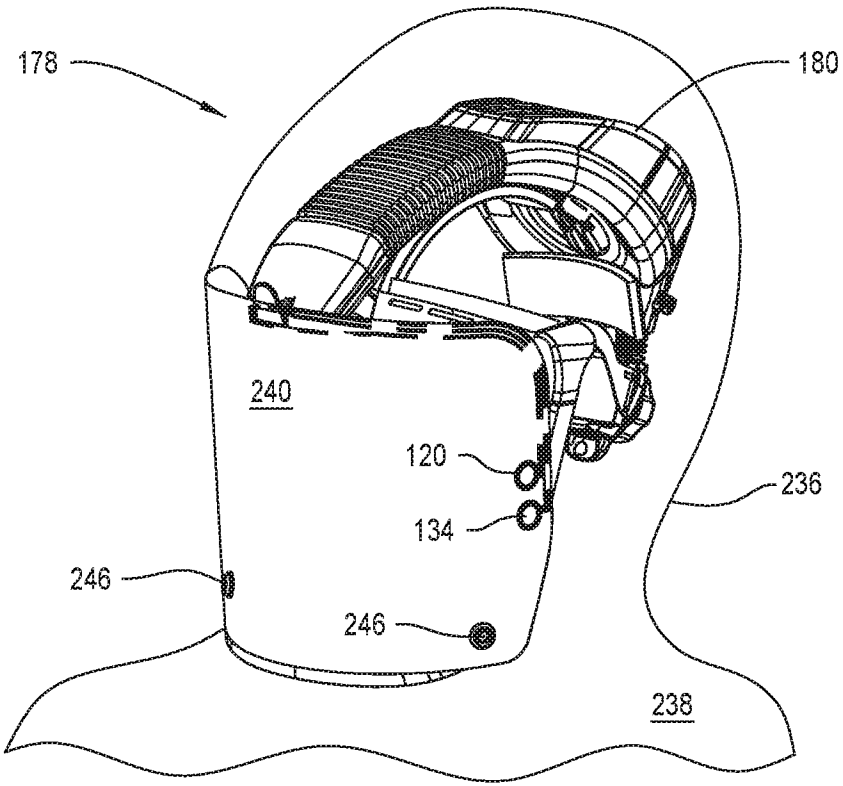
FIG. 8 is a perspective view of an alternative personal protection system of this invention wherein the fabric shell is not shown.

FIG. 8 illustrates an alternative system 178 of this invention. System 178 includes helmet 180 and garment 236. Again, so the other components of system 178 can be seen, the shell 238 of the garment 236 is only seen in outline.

Figure 9:
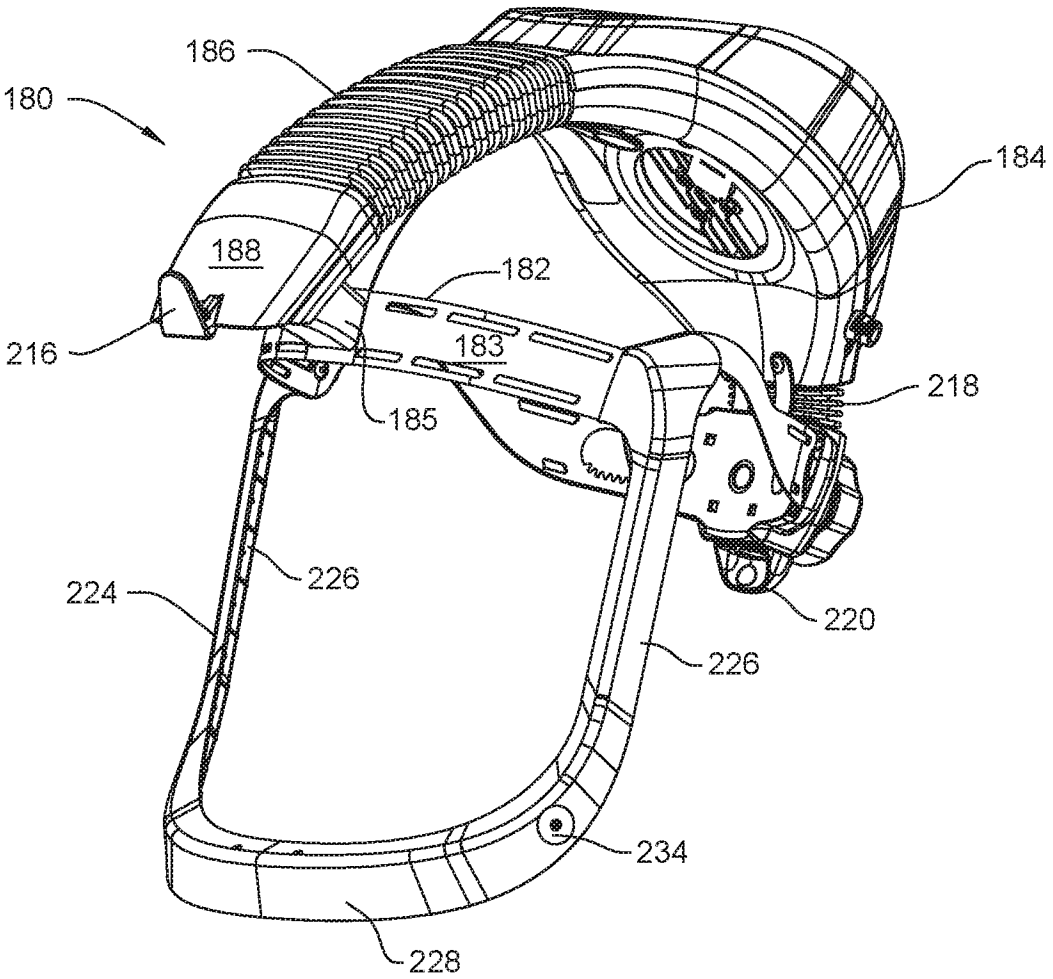
FIG. 9 is a perspective view of the helmet of the system of FIG. 8.

Helmet 180 as seen in FIG. 9, includes a headband 182. A shell 184 is supported by and located above the headband 182. The previously described motor 92 and fan 94 subassembly is disposed in the shell 184. A front bellows 186 extends forward from the shell 184. Front bellows 186 extends to a front nozzle 188. The front nozzle 188 is mounted to the front of the headband 182. A rear bellows 218 extends from the rear of shell 184. The rear bellows extends to a rear nozzle 220. The rear nozzle 220 is mounted to the back of the head band 182. When the system including helmet 180 is actuated, the fan draws air through the garment into the top of the shell 184. The air is discharged through front and rear bellows 186 and 218, respectively. The air that flows through the front bellows 186 is discharged in front of the face of the individual wearing the system. The air that flows through the rear bellows 218 is discharged through the rear nozzle 220. Rear nozzle 220 is positioned so as to open below the headband 182. The air discharged from the rear nozzle 220 can be discharged against the back of the neck of the individual wearing the system.

The front nozzle 188 of helmet 180 includes a block 185. The block 185 is the portion of the nozzle 188 that is mounted to the headband 182 or a component of the helmet 180 integral with the headband. In the illustrated version of the invention, block 185 is mounted to a strap 183 that is part of the headband 182.

Figure 10:
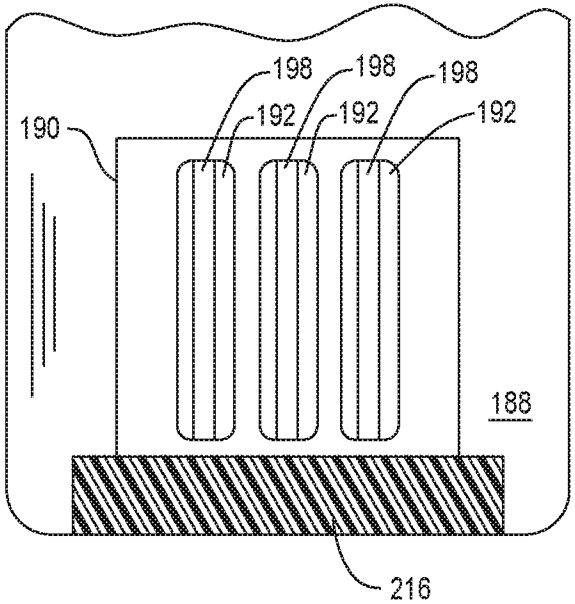
FIG. 10; depicts the contacts integral with the helmet of FIG. 9.
Figure 12:
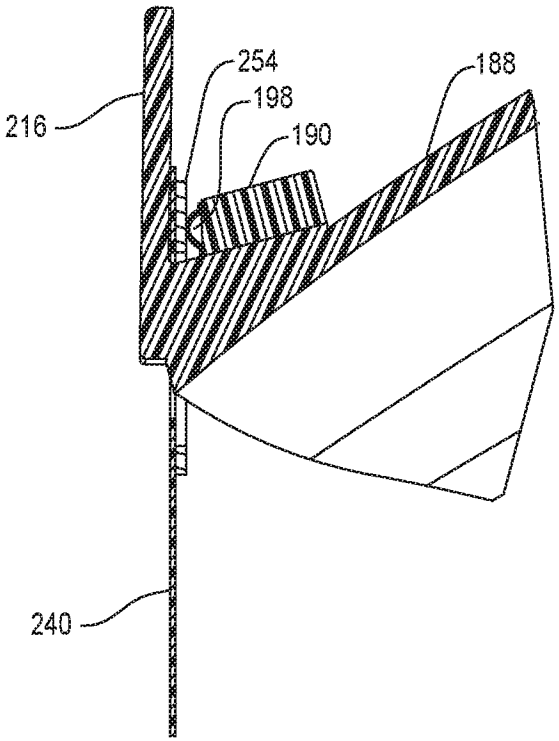
FIG. 12 is a cross sectional view depicting the releasable mounting of the face shield to the hood of the system of FIG. 8.

Front nozzle 188 is also formed to have a tab 216. The tab 216 protrudes upwardly from the front edge of the nozzle. As seen in FIGS. 10 and 12, a block 190 protrudes outwardly from the top surface of the front nozzle 188. Block 190 is spaced rearwardly away from the rearwardly directed face of the tab 216. In FIG. 10, the base of tab 216 below the block is shown in cross section so the block 190 and associated components behind the tab can be seen. The forward directed face of block 190 is formed to have three elongated slots 192. A contact 198 is disposed in each of the slots 192. Each contact 198 is in the form of a conductive, flexible strip of metal. The contacts 198 are so as to be outwardly bowed. More particularly the contacts are formed so as to extend forward of block 190. Typically helmet 180 is formed so that when a garment is not disposed over the helmet, the contacts abut the rearwardly directed face of tab 216. While not illustrated, in some versions of the invention a plate that consists of a frame and a series of webs is disposed over block 190. The frame is configured to retain the contacts 198 in the slots 192.

Helmet 180 includes the detector 85 and controller 88 described with respect to the first embodiment of the invention. While not illustrated, it should be understood that in this version of the invention conductors, similar to conductors 82, connect each contact 198 to the detector 85.

The helmet 180 includes a chin bar 224 that extends downwardly from the front of the headband 182. Chin bar 224 includes two posts 226 that extend from opposed sides of the head band 182. A beam 228 extends between the opposed free ends of the posts 226. Chin bar 224 is formed so beam 228 is located below and slightly forward of the chin of the person wearing the system 178. The beam 228 bows outwardly from the ends of posts 226. Two magnets 234, one magnet shown, are mounted to the chin bar 224. Each magnet 234 is located adjacent an outer end of beam 228 of the chin bar 224.

Figure 11A:
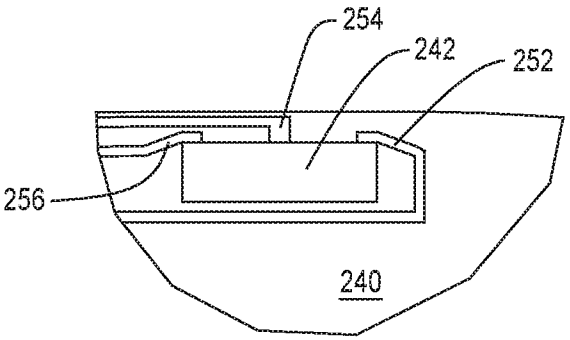
FIG. 11A is an enlarged portion of FIG. 11.
Figure 11:
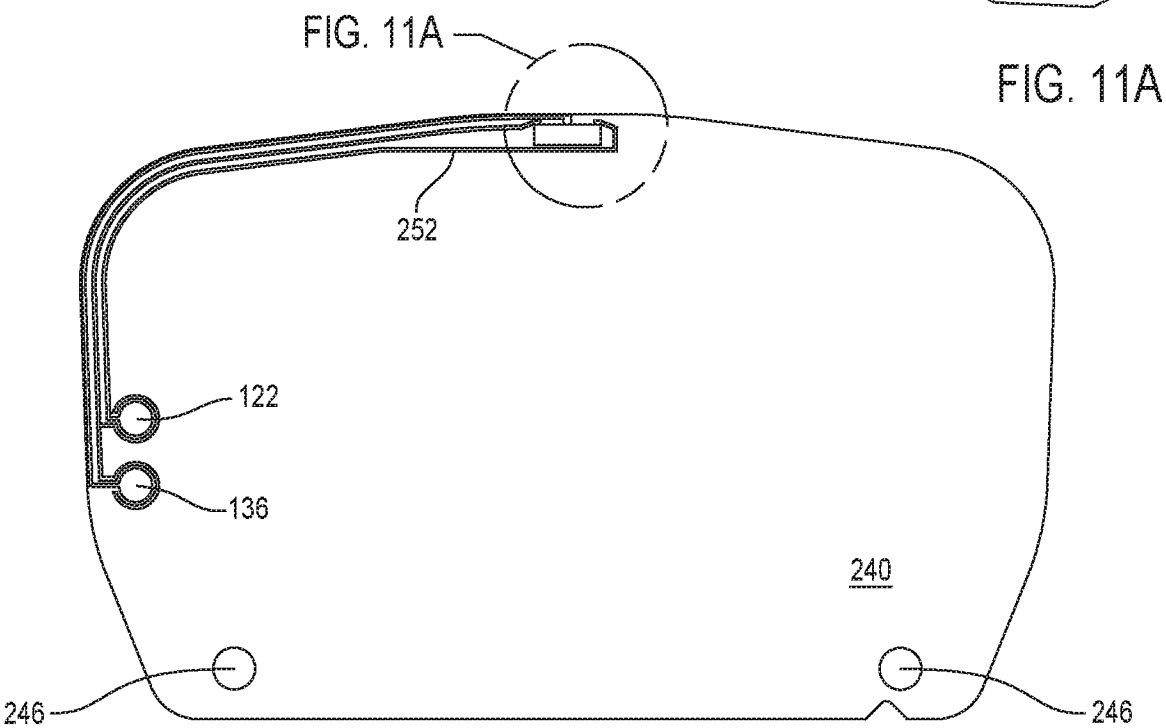
FIG. 11 depicts the inner face of the face shield of the garment of the system of FIG. 8.

The face shield 240 is mounted to an opening formed in shell 238 of garment 236, (opening not identified). Face shield 240, as seen in FIG. 11, has the same general shape as the previously described face shield 110. The face shield 240 is mounted to an opening formed in shell 238 of garment 236. Face shield 240 is further formed so below the top portion of the face shield there is a rectangularly shaped opening 242. Opening 242 is shaped to receive the tab 216 integral with the helmet 180. Two magnets 246 are mounted to the face shield 240 so as to extend inwardly from the inwardly directed surface of the face shield. Collectively, the components of this version of the invention are formed so that, when the helmet tab 216 is seated in the face shield opening 242 and the face shield 240 is flexed around the chin bar 224, each of the face shield magnets 246 will abut and latch to a complementary one of the magnets 234.

The previously described buttons 120 and 134 are formed on the inner surface of the face shield. Not identified are the disk 122 and ring 126 that form button 120 and the disk 136 and ring 142 that form button 134. A conductor 252, analogues to and having the same general shape as conductor 124, extends from disk 122. A conductor 254 analogues to and having the same general shape as conductor 128 extends from the rings 126 and 142. A conductor 256 analogues to and having the same general shape as conductor 144 extends from disk 136. Conductor 252, 254, and 256 differ from conductors 124, 128 and 144 in that each of conductors 252, 254 and 256 has a tail end located over a portion of the face shield that defines the perimeter of opening 242. As seen in FIG. 11A the tail end of conductor 252 terminates over the section of face shield that defines the top right perimeter portion of the opening 242. Conductor 254 terminates over the section of the face shield that defines the top center section of the opening 242. The tail end of conductor 256 terminates over a section of the face shield that defines the top left perimeter of opening 242.

Collectively, the components forming this version of the system are constructed so that, when the helmet tab is fully seated in the face shield opening 242, the tail end of each one of the conductors 252, 254 and 256 is in registration with a separate one of the contacts 198.

To use the system 178, helmet 180 is first placed on the head of the individual. Garment 236 is initially placed above the face of the individual. More particularly, the garment is positioned so that when the garment is brought towards the face, the tab 216 integral with the helmet will seat in the opening 242 internal to the face shield. As a result of the face shield being further urged downwardly, into the space between block 190 and tab 216, the tail end of each conductor 252, 254 and 256 goes into physical contact with the associated contact 198 integral with the helmet 180. FIG. 12 illustrates how one conductor, arbitrarily, conductor 254, abuts the associated contact 198.

Once the face shield 240 is seated over tab 216, the garment shell 238 is unfolded around the helmet 180 and the portions of the anatomy of the individual the system is intended to cover. Also, the face shield 240 is flexed around the helmet. More particularly, face shield 240 is flexed so that each one of the magnets 246 integral with the face shield releasably engages the complementary magnet 236 integral with the helmet 180. As a result of the magnets 236 and 246 so engaging, the face shield 240 has from side-to-side a curved shape around the head of the individual. Providing the face shield with this curved shape increases the field of view outside of the face shield of the individual wearing the system. The curving of the lower portion of the face shield is limited by the abutment of this section of the face shield with beam 228 integral with the chin bar 224.

It should be appreciated that, with the engagement of the conductors 252, 254 and 256 with the contacts 198, electrical connections are established between the buttons 120 and 134 and the detector 85. Electrically, this version of the system functions in the same way the first version of the system functions. Should the individual want to control the fan speed, the individual depresses the appropriate button 120 or 134. In response to the change of capacitance caused by this action, the detector 85 sends an appropriate signal to the controller. Controller 88, in turn adjusts the speed of the motor based on which button is depressed.

A further benefit of this system 178 of this invention is that expense of providing components that are required to perform two functions, the physical fastening and electrically connecting of the face shield to the helmet is eliminated. Also, system 178 simplifies the centering of the face shield 240 with the helmet 180.

II. Second Alternative System

Figure 13:
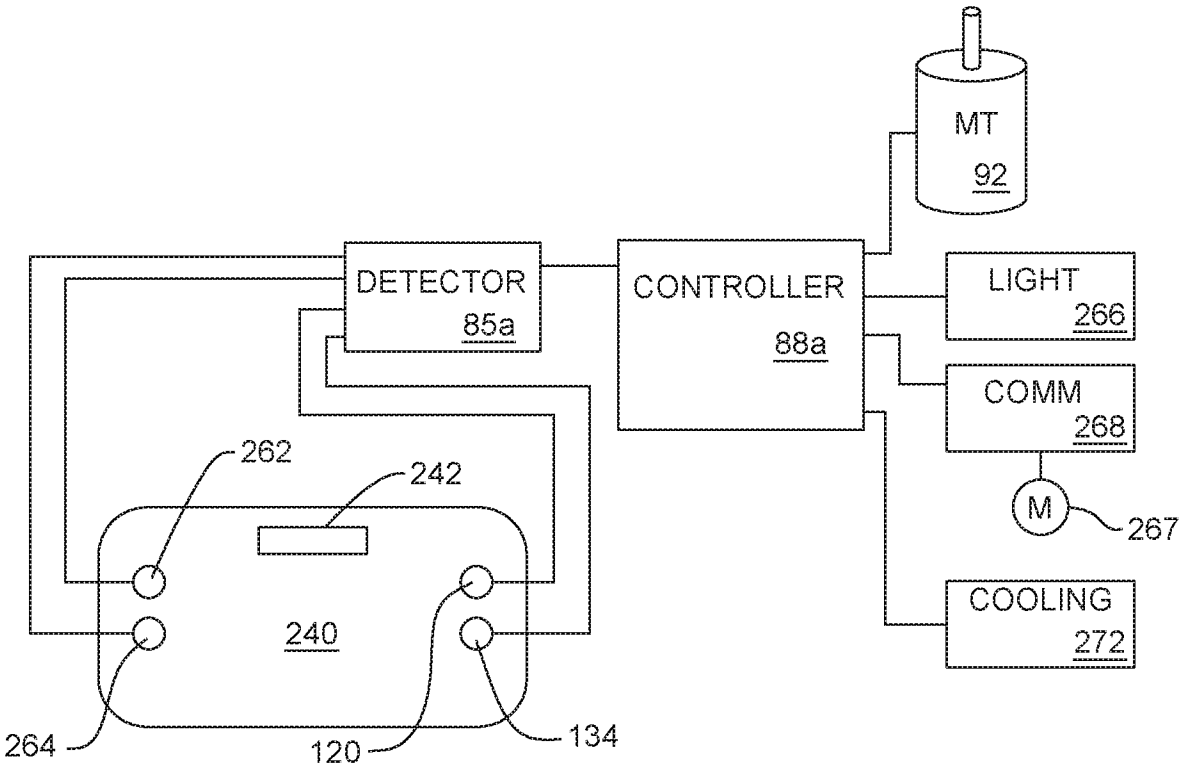
FIG. 13 is a block diagram of the electrical components of an alternative personal protection system of this invention.

FIG. 13, illustrates the electrical components of the invention with three face shield-mounted control buttons, buttons 120, 134, 262 and 264. In FIG. 13, the buttons 120, 134, 262, 264 are shown on the opposed sides of the face shield. Not shown are the contacts integral with the helmet and face shield 240 that connect the buttons to the detector 85*a*. In this version of the invention, the helmet, in addition to having a fan motor 92, has a light 266, a communications unit 268 and a cooling strip 272. The light 266 is typically mounted to the helmet to emit a beam of light out of the face shield 240. The communications unit 268 may be a RF transceiver. Alternatively, the communications 268 unit may include an amplifier with a speaker. In either case, the communications unit typically includes a helmet mounted microphone 267. This microphone 267 is typically attached to the chin bar. The cooling strip 272 typically consists of components capable of drawing heat away from the skin of the individual wearing the personal protection system. One such strip is disclosed in the incorporated by reference US Prov. Pat. App. No. U.S. Prov. Pat. App. No. 62/221,266. Controller 88*a* in this version of the invention regulates the operating state of each of these sub-assemblies 92, 266, 268 and 272 of the system.

In this version of the invention each one of the buttons 120, 134, 262 and 264 is used to regulate the operating state of each one of the electrically powered sub-assemblies 92, 266, 268 and 272 of the system. Arbitrarily, when controller 88*a* receives an indication that button 120 is depressed, the controller steps up the speed of the fan motor 92. When fan motor 92 is at the highest speed and button 120 is depressed, controller 88*a* resets the energization signal applied to the motor 92 so the motor runs at the lowest speed. Based on the depression of button 134, the controller 88*a* turns on or turns off the light 266. Based on whether or not button 262 is depressed the controller turns on or turns off the transmitter or amplifier integral with the communications unit 268. Based on the depression of button 264 the controller sets the voltage level across the active components of the cooling strip 272 so as to set the heat sinking abilities of the strip.

Thus, it should be understood that the buttons of the system of this invention may be used to control electrically active components of personal protection system other than a fan motor. Likewise, in some versions of the invention, depending on the type of electrically powered assembly integral with the helmet, it may only be necessary to provide a single button on the face shield for controlling the assembly.

IV. Third Alternative System

Figure 14:
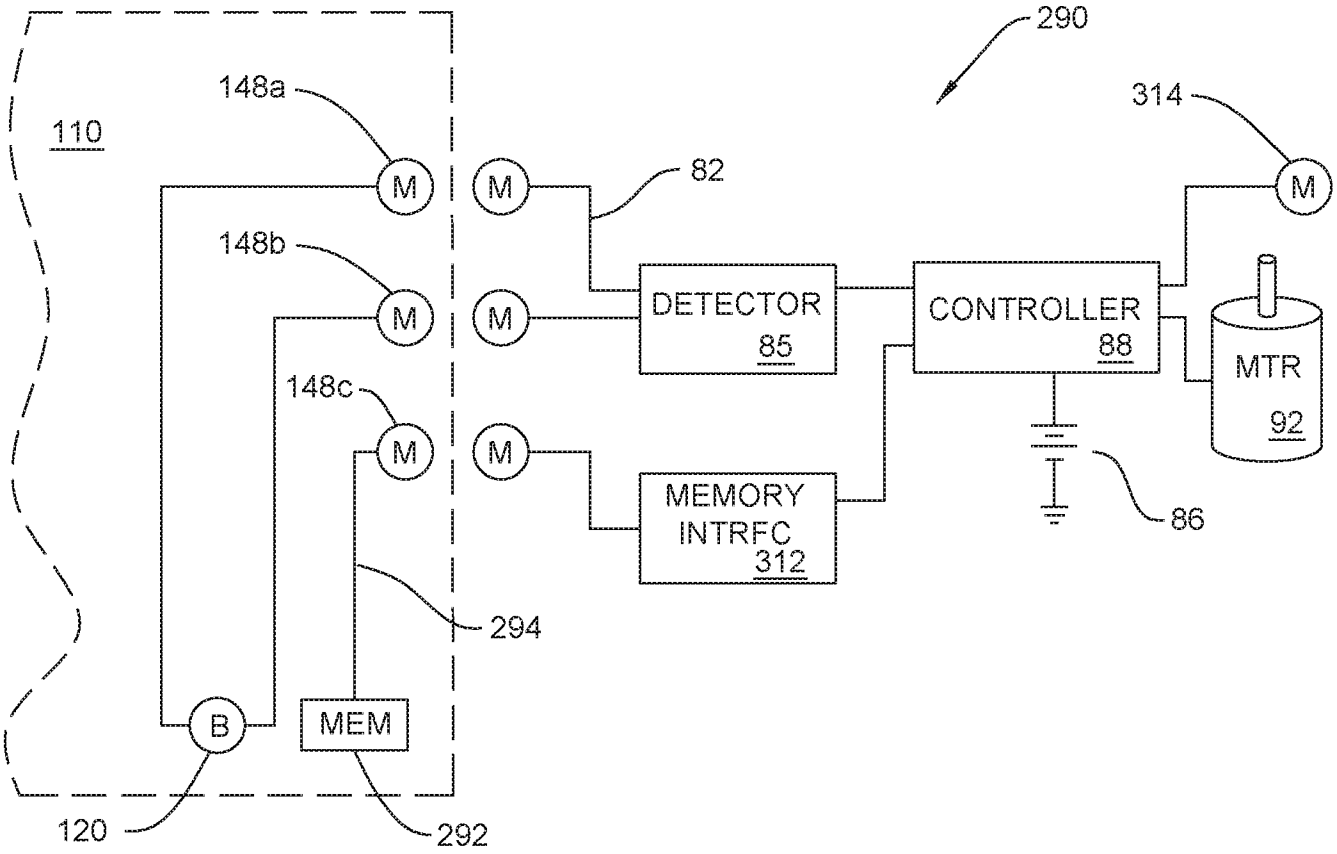
FIG. 14 is a block and diagrammatic depiction of some of the components of a personal protection system of this invention wherein a memory is mounted to the garment.

FIG. 14 depicts how a personal protection system 290 of this invention may be provided with a garment-mounted memory 292. FIG. 14 depicts the electrical components of system 290. It should be understood that these components may be mounted to the helmets and garments of the previously described systems 30 and 178 as well as alternative helmets and garments of this invention. System 290 includes the previously described face shield 110 that is secured to a garment (garment not illustrated). A single button, button 120, is formed on the face shield.

Also mounted to the face shield 110 is a memory 292. Memory 292 stores data useful for regulating the operation of the system 290. FIG. 15 depicts the type of data stored in memory 292. These data include, in a field 302, data identifying the type of garment with which the face shield is associated. A field 304 contains data describing a minimum fan speed. A flag field 306 contains flags that may be set to indicate whether or not it is appropriate to use certain types of electrically active components with this particular helmet. For example, it is known to provide some helmets with light assemblies that emit ultraviolet light. Certain garments may include face shields through which it is not appropriate to emit ultraviolet light. In this type of garment one of the flags internal to the field may be set to indicate that, if the helmet includes an ultraviolet light, the light should not be actuated if this garment is disposed over the helmet.

Memory 292 also includes a use history field, field 308. Use history field contains data indicating whether or not the garment with which the memory is integral was previously used. Use history field 308 may be a single bit flag field. At manufacture of the garment, data are loaded in each of memory fields. The data in the use history field 308 are set to indicate that the garment was previously not used.

Memory 292 may be a thin film memory label that is adhesively secured the inner surface of the face shield 110. In FIG. 14 a single conductor 294 is shown connecting the memory 292 to a contact, arbitrarily contact 148*a*. It is understood that in some versions of the invention, it may be necessary to read/write data to memory 292 over plural pins integral with the memory. In these versions of the invention, it will be necessary to provide the face shield with sufficient contacts to ensure that each memory pin is connected to a contact.

The helmet of the system 290 includes the previously described magnets 64 that function as electrical contacts, the detector 85 and the controller 88. System 290 is shown as only having the fan motor 92. It is understood that system 290 may have other electrically active components. The helmet of system 290 also includes a memory interface 312. Memory interface 312 is configured to both read data from and write data to memory 292. Memory interface 312 is connected to controller 88. Based on instructions from controller 88, the memory reader 88 reads the data in the memory and forwards these data to the controller. Also based on instructions from controller 88, the memory reader writes data to the memory 292. The data writing typically consists of setting the flag in the use history field 308.

System 290 of this invention also includes an alarm 314. The alarm 314 is typically a device capable of emitting a short audible burst of sound. Controller 88 is connected to the alarm to selectively actuate the alarm.

In system 290 the components that connects the memory 292 to the complementary magnets 64 integral with the helmet are magnets 148*a* and 148*b*.

System 290 of this invention is readied for use the same way the other versions of the person protection system of this invention are readied for use. The helmet is fitted over the head of the individual. The garment is fitted over the helmet and the head. As a consequence of the fitting of the garment over the head, the contacts integral with the helmet and face shield establish an electrical connection between the button 120 and the detector 85. The contacts also establish an electrical connection between the memory 292 integral with the garment and the memory interface 312.

Figure 16:
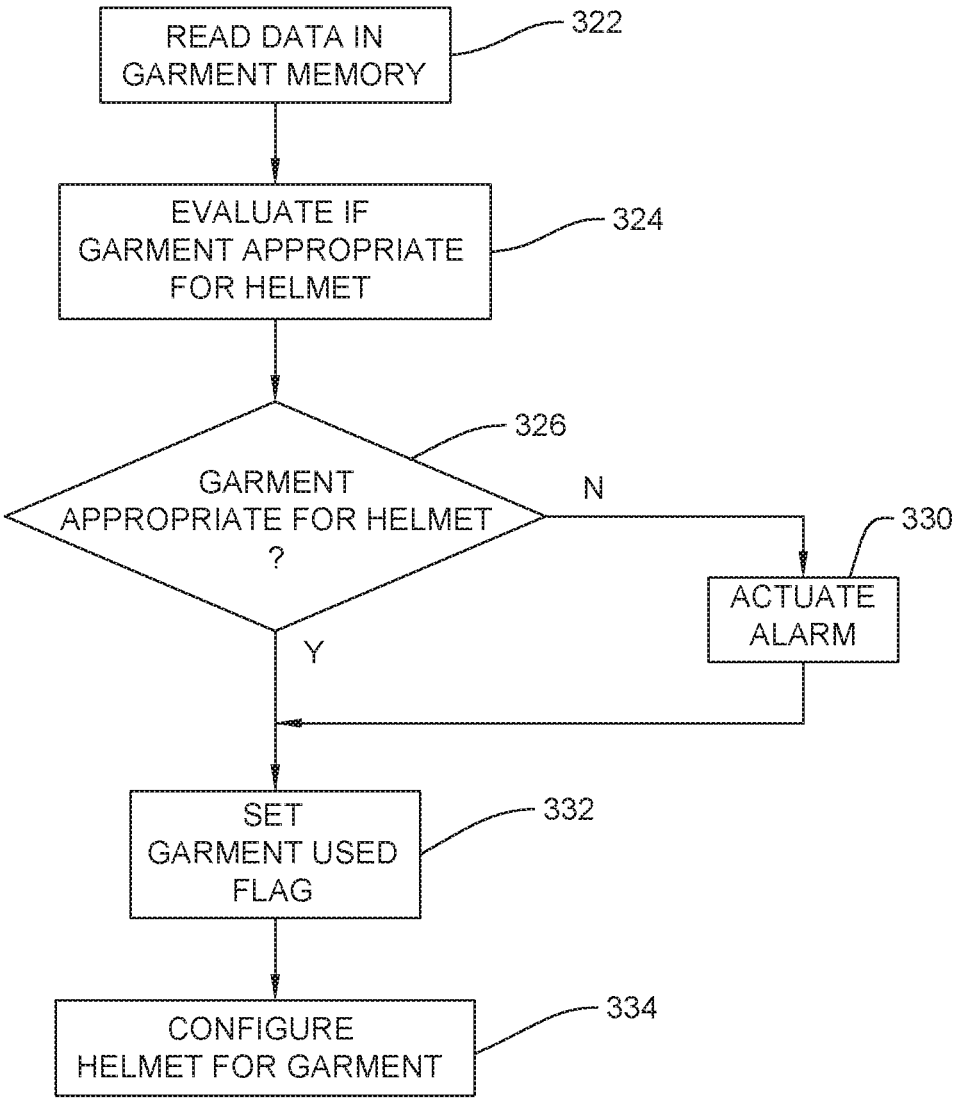
FIG. 16 is a flow chart of how, in response to the data in the garment memory, the controller regulates the operation of the system.

FIG. 16 is a flow chart of the process steps executed by controller 88. These process steps occur after system 290 is readied for use and the controller 88 is activated, (step not shown). Step 322 represents the initially reading of the data in memory 292 by the controller 88. Not explicitly shown but understood to be part of step 322 is an initial outputting of interrogation signals by the memory interface 312 to determine whether or not memory 292 is present. If a memory is not detected, the memory reader sends a notification of this fact to the controller 88. Controller 88 upon receiving this notification, actuates the alarm 314. The activation of the alarm 314 provides notice that either the garment does not have a memory or it is necessary to ensure the garment is fitted to the helmet in such a way as to ensure that the memory 292 is connected to memory reader 312.

Assuming the memory interface, in step 322 is able to successfully read the data in the memory 292 and forward these data to the controller 88, step 324 is the analysis of the data by the controller. In step 324, the data are evaluated to determine whether or not the garment is appropriate for use with the helmet. In step 324, based on data in the garment identification field 302, controller 88 determines whether or not the garment is compatible with the helmet. Based on data in the use history field 308, the controller 88 determines if the garment was previously used. If this evaluation tests positive, it is assumed the garment is no longer sterile and their not fit for use.

Step 326 represents the controller 88, based on the evaluation of step 324, determining that the garment is not fit for use. The reasons the garment may not be fit for use include: owing to the nature of the material forming the shell or filter, the fan may not be able to draw sufficient air into the garment; a feature of the garment may be incompatible with a feature of the helmet; or the data in the use history field indicates the garment was previously used. Regardless of the reason, if it is determined as part of step 326, the garment should not be used with the helmet, in a step 330, controller 88 actuates the alarm 314.

More often, it is expected the evaluation of step 326 will indicate that the garment is compatible for use with the helmet. The controller 88 procedures to execute step 332.

In many versions of the invention, controller 88 even executes step 332 after step 330 is executed. This is because in these versions of the invention, the system is configured to only give notice that the garment is not fit for use; the system does not inhibit use of the garment. Alternatively, system 290 may be configured to not allow operation of the system if the garment is not fit for use. In these versions of the invention, controller 88 does not engage in any further operating after the alarm is actuated.

In step 332, the controller 88 and memory interface 312 write data to the garment memory 292 to indicate that the garment should now be considered used. In the described version of the invention, in step 332, memory interface 312 performs this task by setting the appropriate flag in the use history field of the memory 292.

Step 334 is controller 88 configuring the helmet for use with the particular garment. In the described version of the invention, step 334 performs this process by setting the base signal of the minimum speed for the fan motor to the speed specified in minimum fan speed field 304. Thus, if the garment includes a filter that is relatively porous, the data in field 304 indicates that the minimum fan speed can be relatively low. Another garment may have a relative less porous filter. For the system to function using this garment, the minimum fan speed is set to a higher rate than when a garment with a more porous filter is fitted to the helmet. Field 304 for this garment contains data that indicates this fact.

In some versions of the invention, an integral part of step 334 is the controller 88 actuating the motor 92.

One benefit of system 290 of this invention, is that the controller 88 and alarm 314 are configured to provide an indication if it may not be appropriate to use the system with the particular garment fitted over the helmet.

A further benefit of system 290 is that, based on the memory integral with the garment, the controller configures the system for use with the garment. This control can include setting a minimum speed for the fan motor. Alternatively, if the light can emit light of variable intensity, this control can including setting a minimum, maximum and/or target intensity for the emitted light based on the material properties of the face shield through which the light is directed.

V. Alternative Contacts

This invention is not limited to personal protection systems wherein the conductors that extend from the buttons extend to the fastening feature (or features) that releasably hold the face shield to the helmet. Typically, but not always, the conductors will at least extend to locations of the face shield, that, when the face shield is secured to the helmet, are in registration with the complementary contacts integral with the face shield. This design feature ensures that, as a result of the releasable attachment of the face shield to the helmet, electrical connections are established between the one or more buttons and the electrical components integral with the helmet.

In versions of the invention wherein face shield conductors do not terminate at the fastening features it is understood that the complementary helmet contacts may not be integral with or adjacent the helmet fastening features that engage the face shield fastening features. For example when the face shield conductors terminate at locations spaced from the face shield fastening features, the helmet contacts may be spring loaded, pogo-pin like contacts. Each of these contacts is positioned so that when the face shield is in place, the conductive pin of the contact abuts the appropriate face shield conductor.

While there is no requirement that in all versions of the invention, the face shield fastening feature also function as the conductive contact for a face shield conductor, it is believed that this may often be a preferably construction of the invention. For the purposes of being considered a face shield fastening feature, a section of the face shield that defines an opening for receiving the complementary helmet fastening feature is considered a face shield fastening feature. Thus, the section of face shield 240 that defines the opening 242 of FIG. 11A is understood for the purposes of this invention to be considered a face shield fastening feature.

Fastening features that are also conductive are not limited to magnets and opening defining sections of the face shield. One alternative dual function fastening assembly consists of the two components of a hook-and-loop fastening assembly wherein both components of the assembly are conductive. Another dual function assembly are terminal components that consist of two pairs of connectors. One connector includes a magnet and a contact. The second connector consists of a metal attracted to magnetic fields and a second contact. These connectors are configured so that an inherent effect of the latching to the magnet is the abutment of the contacts together. Another type of conductive fastening feature are conductive snaps.

In versions of the invention, wherein the fastening features rely on the magnetic attraction, it is not necessary that both the helmet and garment face shield have fastening features that both conductive and emit a magnetic field. Thus in some versions of the invention only one of the helmet or face shield is provided with electrically conductive magnets that service both as fasteners and conductors. The other of the face shield or helmet is provided with the previously described disks 149 that serve as the complementary fastener and electrically conductive contact.

The contacts of this invention over which signals are transferred between the garment mounted buttons and/or memory are not limited to components that transfer signal through the physical transmission of electron flow. For the purposes of this invention, helmet and garment contacts are considered to be components that facilitate the inductive transfer for signals from the garment mounted components and the helmet mounted components.

Figure 17:
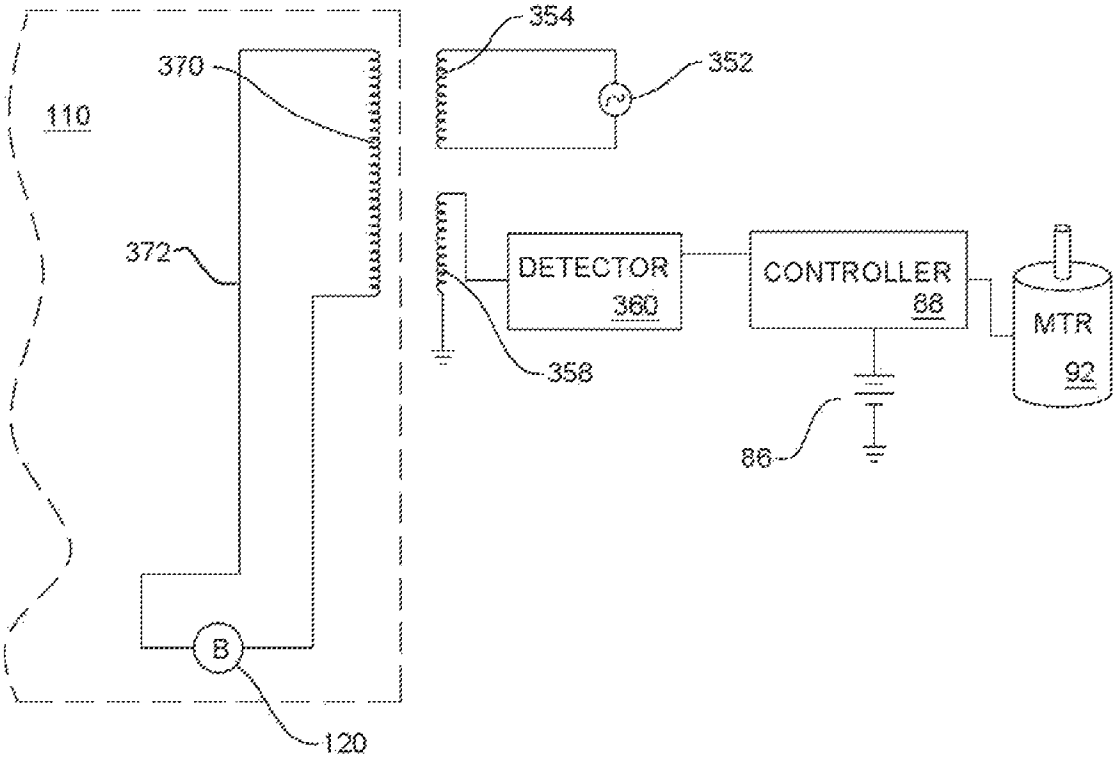
FIG. 17 depicts an alternative means of establishing a connection between the electrically active components on the garment and the components on the helmet of a personal protection system of this invention.

One such assembly is seen in FIG. 17. Here, mounted to the helmet is a primary coil 354. A signal is applied to the primary winding from a constant frequency AC voltage source 352 also part of the helmet. Adjacent the primary coil 354 is a tickler coil 358. A detector 360 monitors the characteristics of the signal across the tickler coil. Detector 360, is configured to, when sensing a particular change in signal across the tickler coil 358 assert a signal to the controller 88 indicating that that change was detected.

In this version of the invention a secondary coil 370 is disposed on the face shield 110. The secondary coil 370 is positioned so that, when the garment is fastened to the helmet, the secondary coil is able to inductively exchange signals with both the primary winding 354 and tickler coil 358 of the helmet. Conductors 372 connect the opposed ends of the secondary winding to a button. While not seen, it is appreciated one conductor 372 can be connected to disk 122 of button 120. The second conductor is then connected to the ring 126 of the button 120.

When this version of the personal protection system of this invention is operating, voltage source 352 applies an AC signal across the primary coil 354. Owing to the proximity of coils 354, 358 and 370, the signal across coil 354 induces a signal across coil 370. A signal thus appears across the disk 122 and ring 126 forming button 120.

A person actuates button 120 the same way the button is actuated in the other versions of the invention, by placing a finger or thumb in contact with the section of the face shield 110 on which the button is formed. The presence of this digit changes the capacitance across the disk 122 and ring 126 forming the button 120. This results in a change in the characteristics of the signal across coil 370. The detector 360 in response to sensing this change, sends a signal to controller 88 indicating the button was depressed. Controller 88 then resets the operating state of the electrically powered assembly, here fan 92, is appropriate based on the actuation of the button 120.

In versions of the invention wherein the contacts are designed to allow inductive signal transfer, the memory attached to the face shield may be an RFID tag. When this type of memory is present, the face shield contact is the antenna integral with the face shield mounted memory. The helmet contact is the coil integral with the helmet that engages in inductive signal exchange with the tag antenna.

VI. On/Off Control Systems

As mentioned above with respect to step 334 of FIG. 16, a personal protection system of this invention may be constructed so that, only after a garment is mounted to a helmet does the controller 88 assert the signals that result in the actuation of the motor 92 and therefore the fan 94. This eliminates the disadvantages associated with providing a personal protection system with a fan that is actuated prior to the placement of the garment of the helmet. One disadvantage this eliminates is the generation of the noise by the fan 94 when the fan is not serving a useful purpose. A second disadvantage associated with running motor 92 when use of fan 94 is not needed is the drawing down of the charge in the battery 86 by the motor.

Thus, it should be appreciated that in the process described with respect to FIG. 16, the system operates in two states in which different currents are drawn from the battery 86. Initially, when the system is first turned on, a relatively low current is drawn. More specifically, the only current that is drawn is the current drawn that is needed to actuate the controller 88 and the related input output components, the detector 85 and the memory interface 312. Only when a proper garment is fitted over the helmet is the fan actuated. When the system transitions to this operating state it should be appreciated that a higher current is drawn from the battery 86.

Other versions of the system of this invention may have different sub-assemblies for ensuring that only when a garment is fitted to the helmet is the motor 92 that rotates the fan 94 actuated. In one such construction of the invention, the system is constructed so that when the controller 88 is initially actuated, the controller does not assert command signals that result in the actuation of the fan. Only when the controller receives a signal from the detector 85 indicating that one of the buttons 120 or 134 was depressed does the controller cause the fan to be actuated.

Figure 18:
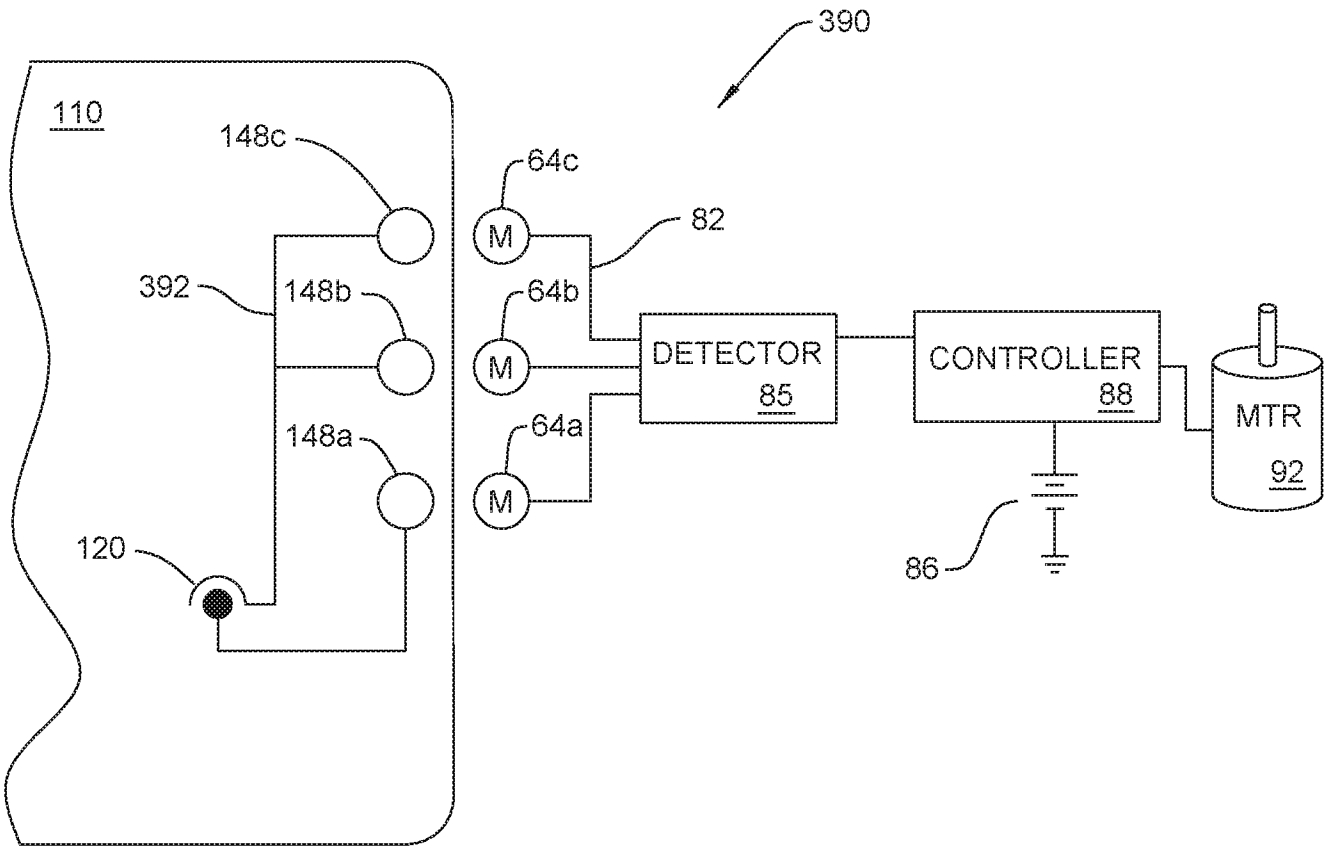
FIG. 18 is a diagrammatic and block diagram of the features of another personal protection system of this invention.

FIG. 18 illustrates components of an alternative system 390 of this invention. System 390 is a variation of the system of FIG. 4. System 390 is constructed so there is a single button 120. Instead of a second button, system 390 is constructed so a conductor 392 is disposed on the face shield 110. Conductor 392 extends between the magnets 148*b* and 148*c*. In these versions of the invention, detector 85 is configured to monitor magnets 64*b* and 64*c* for the presence of an open/closed circuit across these magnets. Thus in these versions of the invention, the detector 85 sources a signal out over magnet 64*b*.

When a helmet of system 390 is initially fitted to the head of the individual and actuated, only the detector 85 and controller 88 are actuated. Since an open circuit is present across magnets 64*b* and 64*c*, the detector 85 asserts a signal indicating that this is the state of the system 390 to the controller. Controller 88 therefore does not assert the control signals that energize the fan motor 92.

When a garment is fitted to the helmet, the conductor 392 integral with the garment face shield closes the connection between magnets 64*b* and 64*c*. Detector 85 senses the closing of the circuit between these two magnets 64*b* and 64*c*. In response to detecting this change in circuit state, the detector asserts a signal indicating that the system is in this state to the controller 88. Only when this signal is received by the controller 88 does the controller assert the command signals that result in the application of the energization signals to the fan motor 92.

It should be appreciated that in this version of the invention, the removal of the garment from the helmet results in the reopening of the circuit between the magnets 64*b* and 64*c*. The detector, in response to the detection of the reopening of this circuit asserts a signal reporting the system is in this state to the controller 88. Controller 88 in response to receiving the indication that the system 390 has returned to the garment off state, terminates the application of energization signals to the fan motor 92. Thus, a further feature of these constructions of the system of this invention is that, when the garment is removed from the helmet and use of the fan motor 92 is no longer required, the fan is automatically shut off.

Figure 19:
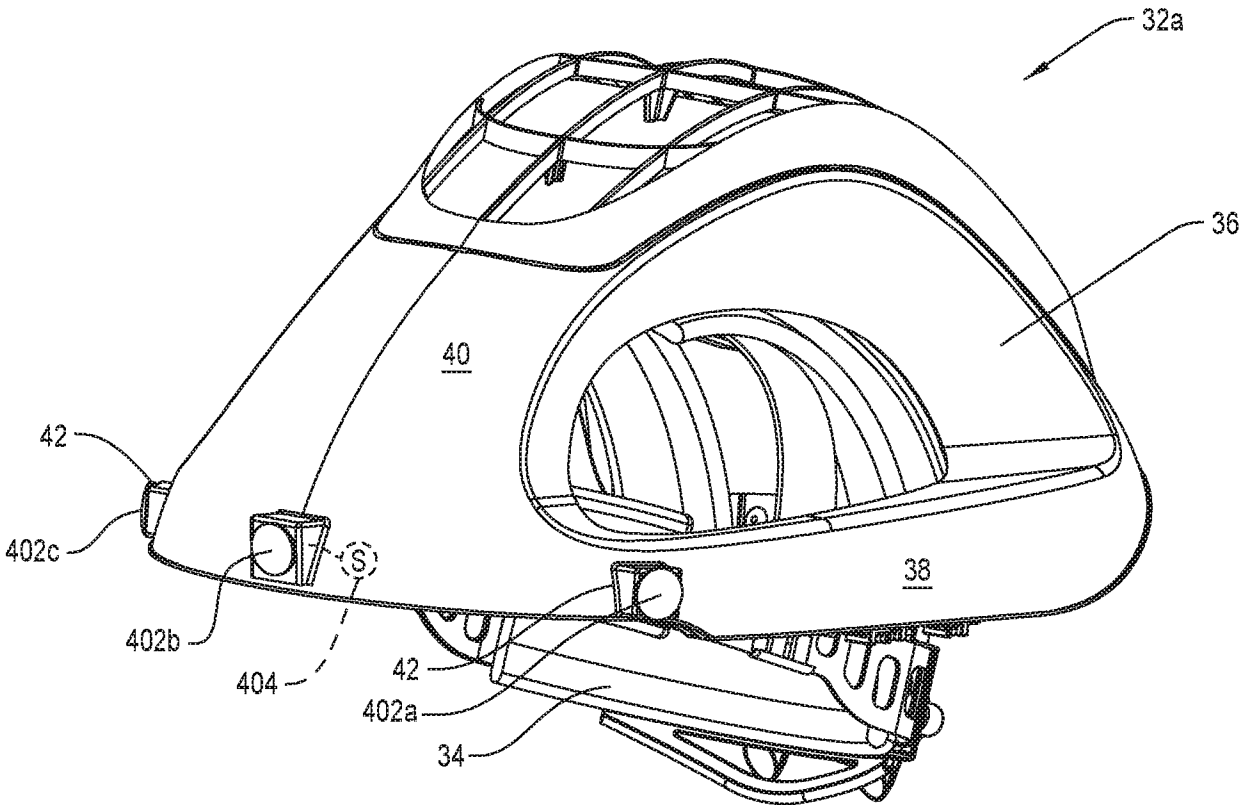
FIG. 19 is depicts a helmet of an alternative personal protection system of this invention.
Figure 20:
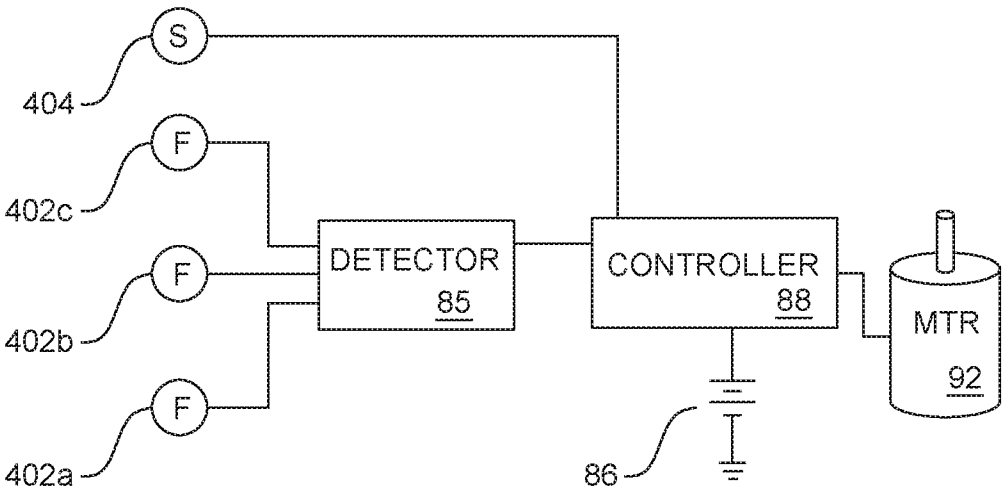
FIG. 20 is a block diagram of the electrical components integral with the helmet of FIG. 19.

Another means to detect the absence/presence of the garment is illustrated by FIGS. 19 and 20. FIG. 19 illustrates a portion of a helmet 32*a* that is based on the previously described helmet 32. Helmet 32*a* differs in part from helmet 32 in that, instead of having magnets as fasteners, helmet 32*a* has fasteners 402*a*, 402*b*, 402*c* that are conductive and attracted to magnetic fields. Adjacent fastener 402*b* is a sensor 404. Sensor 404 outputs a signal the state of which changes based on the absence or presence of a magnetic field. Sensor 404 can be a Hall effect sensor. In some versions of the invention, sensor 404 is a switch. The open/closed state of this switch is understood to be a function of the absence or presence of a magnetic field. The sensor 404 is mounted inside the shell 36. This is why, in FIG. 19, sensor 404 is shown in phantom.

The signal output by the sensor 404 is output to the controller 88. This signal may be applied directly to the controller as seen in FIG. 20. Alternatively, the signal may be applied to the detector 85. The detector of this version of the invention is thus configured to, upon receipt of this signal, output a signal to the controller indicating that the garment is attached to the helmet.

In these versions of the invention, the complementary fastening component integral with the garment is the previously described face shield magnet 148.

This version of the invention is readied for use using the same basic steps employed when the other versions of the invention are readied for use. With this version of the invention, the actuation of the helmet only results in the actuation of the detector 85 and controller 88. To removably attach a garment to helmet 32*a*, magnets 148*a*, 148*b* and 148*c* integral with the garment face shield 110 are placed against fasteners 402*a*, 402*b* and 402*c*, respectively, with the helmet 32*a*. The magnetic field generated by the magnet 148*a* positioned adjacent sensor 404 flows around the sensor. The sensor 404, in turn, outputs a signal indicating that this field is present. Again, if the sensor 404 is a switch, the indication of the presence of the field is either the closing or opening of the switch. In response to the sensor outputting this signal, the controller 88 initiates the application of energization signals to the motor 92 so as to actuate the motor and rotate the fan 94.

Figure 21A:
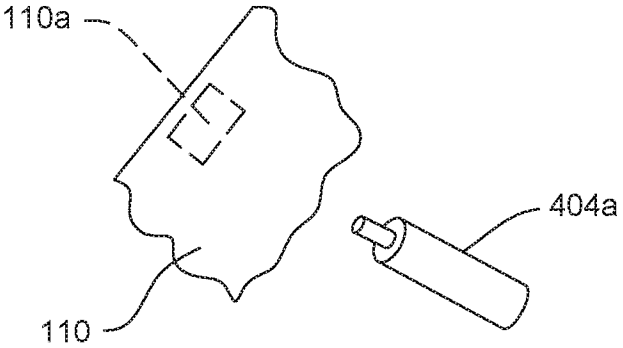
FIGS. 21A and 21B are diagrammatic depictions of alternative sensors for detecting the presence of a face shield adjacent the helmet.

Alternatively, the sensor that asserts a signal indicating whether or not a garment is fitted to the helmet may be a switch, switch 404*a* in FIG. 21A, that is physically displaced upon the fitting of the garment to or removal of the garment from the helmet. In these versions of the invention sensor 404*a* can be a switch with a spring-loaded pin. The switch is fitted to the helmet to be at a location at which, when the garment is mounted to the face shield, a portion of the garment will displace the pin. Typically, the switch is mounted to the helmet so, when the garment is fitted over the helmet, either the face shield or a component attached to the face shield abuts and displaces the pin. This displacement of the pin causes the state of the switch to change. The controller is connected to the switch. Accordingly, the controller 88 is set to recognize that the state of switch serves as an indication regarding whether or not a garment is fitted over the helmet. Based on this switch state information, the controller regulates the application of the energization signal to the fan motor 92.

It should thus be appreciated that in the above-described version of the invention the portion of the garment that depresses the switch of sensor 404*a* functions as the garment indicia that indicates the presence of the garment adjacent the sensor. In FIG. 21A this is represented diagrammatically by a section 110*a* of face shield 110.

In some versions of the personal protection of this invention, based on the information indicating whether or not a garment is fitted to the helmet the controller may regulate whether or not other electrically powered assemblies integral with a personal protection system are actuated. Thus, the controller may inhibit the actuation of one or more of the light assembly 266, the communications unit 268 or the cooling strip 272 based on whether or not an appropriate garment is fitted to the helmet.

VII. Alternative Embodiments

The above are directed to specific versions of the invention. It should be understood that the individual features of the different embodiments of the invention may be combined to construct alternative embodiments of the invention.

Similarly, it should be understood that not all features of each embodiment of the invention be present in each construction of the described embodiment. For example, versions of the invention in which a sensor on the helmet monitors whether or not the garment mounted indicia is present may not always include face shield mounted control buttons. In these versions of the invention, the one or more control members that are actuated to control the electrically powered assemblies may be one or more buttons, switches or potentiometers that are mounted to the helmet.

Specific features of the invention may also vary from what has been described.

For example, the face-shield mounted control buttons of this system may be different from what has been described. For example, in some versions of the invention, the buttons and complementary components integral with the helmet may be set to detect changes in button resistance that occur as a result of placing a finger or thumb against the button. In versions of the invention, in which the buttons are sensitive to changes in resistance, it may be desirable to apply the conductive material that form the buttons to the outer surface of the face shield. There may be other reasons in other versions of the invention wherein not only the conductive features of the buttons but also the face shield conductors themselves are located on the outer surface of the face shield.

Further in some versions of the invention, the buttons may include moving components. Typically, this type of button is designed so that at least one moving component needs to be physically displaced relative to another component of the button in order to actuate the button. One such type of button is a membrane type of button or switch. This type of button includes a flexible membrane. The flexure of the membrane closes the circuit of the button with which the membrane is associated.

There is no requirement that in all versions of the invention the buttons be located adjacent the side or sides of the face shield. The buttons may be located near the top and/or bottom of the face shield.

Regardless of their form, it should be understood that a button of this invention should be actuatable upon the depression of a gloved finger. This is because, in a medical or surgical environment, the individual wearing a system of this invention typically has gloved hands.

Also, the buttons of this invention may be mounted to a garment that includes one or more peel away lenses. A peel away lens is a layer of transparent plastic that is adhesively secured to the exposed outer surface of the face shield. In the event this lens becomes covered with material that obstructs the view through the face shield, this lens is removed. This enables the individual wearing the garment to have, at least for a short time, a view through the face shield that is less obstructed by material over the face shield. This removable shield could cover the buttons or leave the buttons exposed.

Further in some versions of the invention, it may be desirable to position the components so the electrical contacts integral with the helmet are, when the garment is fitted over the helmet, in contact with complementary contacts integral with the buttons. In these versions of the invention, the face shield electrical contacts are formed integrally with the buttons. A benefit of this version of the invention is that it would not require the face shield to be provided with conductors that extend from buttons to the spaced away face shield contacts.

An alternative unit that may be attached to the personal protection system is a video and/or audio recording system. The button can actuate this system.

Also in some versions of the invention, the face shield may not include fastening features that engage complementary helmet fastening features.

In some versions of the inventions, it may be desirable to place an insulating layer over the buttons and/or the face shield conductors that extend to the buttons.

Figure 21B:
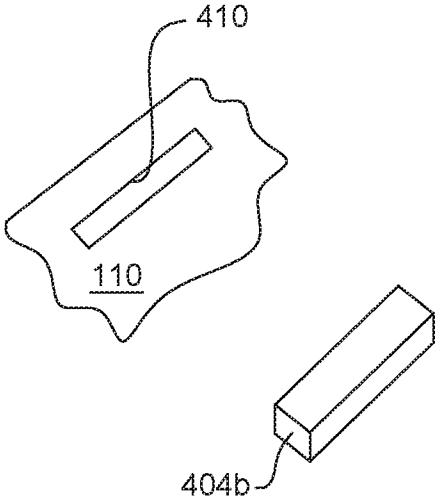

It should likewise be understood that the sensor that outputs a signal based on the presence/absence of a garment may take other forms. FIG. 21B, depicts an alternative sensor 404*b* that is an optical recognition sensor. This sensor, scans the face shield or attached component for a visually perceivable indicia 410 (seen as bar 410 on a portion of a face shield 110 in FIG. 21B). This indicia 410 may be a bar code or a pattern of colored tiles. Based on the presence or absence of an appropriate indicia, the sensor generates a signal indicating whether or not a face shield is mounted to the helmet. Based on the state of this signal, controller 88 selectively actuates one or more of the powered assemblies integral with the personal protection system.

As discussed above in some versions of the invention, a memory device like a NOVRAM or an RFID tag may be attached to the face shield. In these versions of the invention the memory interface that reads data from the memory functions as the sensor that detects the presence or absence of the attached face shield. More specifically, as long as write out requests output by the memory interface do not result in the receipt of data by the memory interface, the controller interprets the personal protection system as being in a state in which a face shield is not attached to the helmet. When, in response to a write out request, the memory interface receives data from the memory, the controller considers the system to be in a state in which a face shield is attached to the helmet. Only when the system is in this state does the helmet actuate one or more of the electrical powered components of the system.

Also while the personal protection system of this invention is generally intended to provide a barrier between the medical practitioner and the patient during a medical or surgical procedure, its use is not so limited. It is within the scope of this invention that the personal protection may be used in other endeavors in which it is desirable to provide a barrier between an individual and the surrounding environment. One alternative endeavor in which it may be so desirable to use the system of this invention is one in which it is desirable to provide a barrier between the individual and hazardous material in the environment in which the individual is working.

Further the form of conductive material on the face shield the form the buttons and the conductive traces is not limited to conductive tracks. In some versions of this invention, these conductive components may be formed from conductive ink that is applied to the face shield. Alternatively, these conductive components may be formed from conductive layers that are applied to the face shield. Once applied to the face shield these conductive layers are selectively etched to form the individual conductive components.

Further the inventive features of the personal protection system of this invention may be incorporated into personal protection systems that do not include the complete helmet and head covering garment illustrated with respect to the primary described versions of the system. For example, a most minimal personal protection system of this invention may consist of helmet may not include an over-skull mounted shell in which a fan and motor are mounted. The garment may only consist of a face shield this is mounted to this helmet. In this version of the system, the above described assemblies may be used to selectively inhibit or allow the use of the electrically powered assemblies attached to the headband as a function of whether or not the face shield is mounted to the headband. The electrically powered assemblies that may be attached to this headband include, the light source 266, the communications unit 268 and/or the cooling strip 272. In these versions of the invention, the buttons for regulating operation of the electrically powered assembly or assemblies may or may not also be mounted to the face shield. When the buttons are so mounted to the face shield, the buttons are electrically connected to the controller connected to the headband through one or more of the above described assemblies for removably making the necessary electrical connections. Thus, for the purposes of this invention a helmet is understood to be an article designed to be worn of the head of the individual to which an electrically powered assembly is mounted. Thus, one minimal helmet of this invention may include a headband to which a cooling strip is mounted.

Accordingly, it is an object of the appended claims to cover all such modifications and variations as come within the true spirit and scope of this invention.

What is claimed is:

1. A personal protection system, said system including:

a helmet configured to be worn on the head of an individual;

an electrically powered assembly mounted to the helmet;

at least one button connected to the electrically powered assembly for regulating an aspect of the operation of the electrically powered assembly; and a garment including a transparent face shield, the garment is removably attached to the helmet and is positioned so that when the garment is attached to the helmet, the face shield is located in front of the face of the individual, the at least one button is mounted to the face shield of the garment;

an electrically conductive contact is mounted to the face shield and is electrically connected to the at least one button; and an electrically conductive contact is mounted to the helmet and is electrically connected to the electrically powered assembly wherein, the electrically conductive contact mounted to the face shield and the electrically conductive contact mounted to the helmet are collectively positioned, so that when the garment is attached to the helmet, the electrically conductive contact mounted to the face shield engages the electrically conductive contact mounted to the helmet so as to establish an electrical connection between the at least one button and the electrically powered assembly.

2. The personal protection system of claim 1, wherein the helmet comprises a helmet fastening feature and the face shield comprises a face shield fastening feature that, when engaged, releasably hold the face shield to the helmet.

3. The personal protection system of claim 2, wherein the face shield fastening feature is electrically conductive and the at least one button is electrically connected to the fastening feature so that the face shield fastening feature functions as the electrically conductive contact mounted to the face shield.

4. The personal protection system of claim 2, wherein the helmet fastening feature and the face shield fastening feature each comprises a magnet or a component that is attracted to a magnetic field.

5. The personal protection system of claim 2, wherein the helmet fastening feature includes a tab attached to the helmet and the face shield fastening feature is an opening in the face shield, the opening dimensioned to receive the helmet tab.

6. The personal protection system of claim 3, wherein the helmet fastening feature is electrically conductive and is positioned to engage the face shield fastening feature of the face shield and is connected to the electrically powered assembly so that the engagement of the helmet fastening feature and the face shield fastening feature results in the electrical connection of the at least one button to the electrically powered assembly.

7. The personal protection system of claim 3, wherein the face shield fastening feature that is electrically conductive consists of a section of the face shield that defines an opening in the face shield for receiving a complementary fastening feature of the helmet, wherein the section of the face shield includes a conductive member positioned to, when the helmet fastening feature is disposed in the opening, engage the conductive contact of the helmet.

8. The personal protection system of claim 6, wherein:

the face shield fastening feature that is electrically conductive is an electrically conductive magnet or electrically conductive component that is attracted to a magnetic field; and the helmet fastening feature that is electrically conductive is an electrically conductive component that is attracted to a magnetic field or is a magnet.

9. The personal protection system of claim 1, wherein, the helmet includes a detector to detect whether the at least one button is connected, the detector adapted to assert a signal when the at least one button is actuated.

10. The personal protection system of claim 9, wherein:

the at least one button is formed from spaced apart conductive traces formed on the face shield, the conductive traces formed and spaced so as to form a capacitor; and the detector is adapted to apply a signal across the conductive traces forming the at least one button, monitor the signal across the at least one button and in response to changes in the capacitance of the at least one button, assert the signal indicating that the at least one button was actuated.

11. The personal protection system of claim 10, wherein:

the at least one button and the electrically conductive contact on the face shield are spaced apart from each other; and a conductor is disposed on the face shield and extends from the at least one button to the electrically conductive contact.

12. The personal protection system of claim 10, wherein the at least one button is located on an inner surface of the face shield.

13. The personal protection system of claim 10, wherein the electrically powered assembly mounted to the helmet is: a fan motor, a light, a communications unit, a cooling strip, or a video and/or audio recorder.

14. The personal protection system of claim 11, wherein a section of the conductor spaced from the at least one button functions as the electrically conductive contact of the face shield.

15. The personal protection system of claim 1, wherein the at least button comprises a plurality of buttons mounted to the face shield.

16. The personal protection system of claim 1, wherein the electrically conductive contact mounted to the face shield and the electrically conductive contact mounted to the helmet are collectively configured so that when the garment is attached to the helmet, there is inductive signal exchange between the electrically conductive contact mounted to the face shield and the electrically conductive contact mounted to the helmet.

17. The personal protection system of claim 1, wherein:

a memory is mounted to the garment, the memory being connected to the electrically conductive contact mounted to the face shield;

the electrically conductive contact mounted to the helmet is configured to exchange signals with the electrically conductive contact of the face shield to which the memory is connected; and a memory interface that is connected to the contact mounted to the helmet so as to be able to at least read data from the memory mounted to the garment.

18. The personal protection system of claim 1, wherein the garment includes a shell that covers a portion of the helmet and the head of the individual, the shell formed from flexible material that forms a barrier between the individual and the surrounding environment and the transparent face shield attached to the shell.

19. A garment for use as a part of a personal protection system, the garment including:

a shell adapted for being disposed over a helmet of the personal protection system and at least the head of an individual wearing the system, the shell formed from flexible material that forms a barrier between the individual and the surrounding environment; and a transparent face shield attached to the shell and positioned so that when the garment is disposed over the helmet, the face shield is located in front of the face of the individual, at least one button is mounted to the face shield; and an electrically conductive contact is mounted to the face shield and is electrically connected to the at least one button, the electrically conductive contact is positioned to and adapted to, when the garment is disposed over the helmet, releasably engage a complementary electrical contact integral with the helmet so as to establish an electrical connection between the at least one button and the helmet.

20. The garment of claim 19, wherein the face shield further comprises a face shield fastening feature, the fastening feature is electrically conductive and the at least one button is electrically connected to the fastening feature so that the face shield fastening feature functions as the electrically conductive contact mounted to the face shield.

21. The garment of claim 19, wherein:

the at least one button and the electrically conductive contact on the face shield are spaced apart from each other; and a conductor is disposed on the face shield and extends from the at least one button to the electrically conductive contact.

* * * * *